US010670049B2

(12) United States Patent
Arai

(10) Patent No.: US 10,670,049 B2
(45) Date of Patent: Jun. 2, 2020

(54) FLUID PRESSURE CYLINDER

(71) Applicant: Seiko Instruments Inc., Chiba-shi, Chiba (JP)

(72) Inventor: Shigehiro Arai, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 26 days.

(21) Appl. No.: 15/848,950

(22) Filed: Dec. 20, 2017

(65) Prior Publication Data

US 2018/0172029 A1 Jun. 21, 2018

(30) Foreign Application Priority Data

Dec. 21, 2016 (JP) ..... 2016-247637
Oct. 18, 2017 (JP) ..... 2017-201516

(51) Int. Cl.
*F15B 3/00* (2006.01)
*F15B 11/072* (2006.01)
*F15B 11/032* (2006.01)

(52) U.S. Cl.
CPC ..... *F15B 3/00* (2013.01); *F15B 11/032* (2013.01); *F15B 11/0325* (2013.01); *F15B 11/0725* (2013.01); *F15B 2211/216* (2013.01); *F15B 2211/71* (2013.01)

(58) Field of Classification Search
CPC .... F15B 11/0725; F15B 11/0325; F15B 3/00; F15B 11/072; F15B 2211/216; F15B 11/076
See application file for complete search history.

(56) References Cited

U.S. PATENT DOCUMENTS 3,146,680 A * 9/1964 Hutter ..... F15B 11/076 92/108

FOREIGN PATENT DOCUMENTS

JP 4895342 B 3/2012

* cited by examiner

*Primary Examiner* — Abiy Teka
(74) *Attorney, Agent, or Firm* — Brinks Gilson & Lione

(57) ABSTRACT

An inner cylinder inside an outer cylinder is disposed to be coaxial to an air pressure supply rod inside the inner cylinder. A first piston is disposed between the air pressure supply rod and the inner cylinder, a pneumatic chamber is disposed on a side of one surface (hydraulic surface) of the first piston in the inner cylinder, and a first hydraulic chamber is disposed on a side of the other surface. A second piston is disposed between the outer cylinder and the inner cylinder, and a second hydraulic chamber is disposed on a side of a surface of the second piston which is provided in the same direction as the hydraulic surface of the first piston in both of the cylinders. The inner cylinder is provided with a communication hole for transmitting a negative pressure along with movement of oil with which the first hydraulic chamber and the second hydraulic chamber are filled. In this configuration, it is possible to shorten an overall length of a fluid pressure cylinder.

20 Claims, 13 Drawing Sheets

SECTION A-A'

SECTION A-A
SECTION B-B
A
A'
B
B
11
12
15
21
22
23
24
26
28
30
41
43
44
50
51
52
60
63
81
82

SECTION A-A'

PNEUMATIC STROKE

HYDRAULIC STROKE

SECTION A-A'

FLUID PRESSURE CYLINDER

RELATED APPLICATIONS

This application claims priority under 35 U.S.C. § 119 to Japanese Patent Application Nos. 2016-247637 filed on Dec. 21, 2016 and 2017-201516 filed on Oct. 18, 2017, the entire content of which are hereby incorporated by reference.

BACKGROUND OF THE INVENTION

Field of the Invention

The present invention relates to a fluid pressure cylinder that generates thrust through a supply of a fluid.

Background Art

In order to realize various types of actuation such as generating desired thrust, "pushing", "lifting", "gripping", "carrying", or "clipping" by supplying a fluid, various fluid pressure cylinders such as a hydraulic cylinder, a pneumatic cylinder, and an air hydraulic cylinder are widely used.

The air hydraulic cylinder converts air pressure into oil pressure inside the cylinder and outputs the oil pressure. Therefore, the air hydraulic cylinder can obtain a function of a hydraulic unit while using a pneumatic device (Japanese Patent No. 4895342).

The air hydraulic cylinder includes two types of fluid chambers inside and is configured to include a hydraulic chamber that generates high thrust to the outside and a pneumatic chamber for increasing a pressure in the hydraulic chamber.

However, the air hydraulic cylinder in the related art has a configuration in which the pneumatic chamber and the hydraulic chamber are coaxially disposed in series, and a moving direction of a piston that functions as a partition between the pneumatic chamber and the hydraulic chamber is coincident with a moving direction of a piston that receives the hydraulic pressure and outputs thrust.

Therefore, in the air hydraulic cylinder in the related art, stroke lengths of the two types of fluid chambers are added, and thus the entire cylinder is long. Hence, the overall length of the cylinder is likely to be longer than that of a common pneumatic cylinder or a hydraulic cylinder which include only one type of fluid chamber.

SUMMARY OF THE INVENTION

An object of the invention is to shorten an overall length of a fluid pressure cylinder.

(1) In the invention according to a first aspect, there is provided a fluid pressure cylinder including: a housing; a first fluid chamber that is formed in the housing and is filled with a first fluid; a second fluid chamber that is formed in the housing and is filled with a second fluid; a first piston that functions as a partition between the first fluid chamber and the second fluid chamber, receives a pressure of the first fluid so as to move in an axial direction of the housing, and pressurizes the second fluid; and a second piston having an annular shape, which is disposed on an outer side from the first piston in a radial direction thereof and receives a pressure of the second fluid pressurized by the first piston so as to move in the axial direction of the housing. The second fluid chamber is formed such that a surface of the first piston which pressurizes the second fluid is disposed in the same direction as a surface of the second piston which receives the pressure of the second fluid.

(2) In the invention of a second aspect according to the first aspect, the fluid pressure cylinder is provided in which the second fluid chamber includes a first chamber in which the second fluid inside is in contact with the first piston, a second chamber which is formed on an outer side from the first chamber in the radial direction and in which the second fluid inside is in contact with the second piston, and a communication path through which the first chamber and the second chamber communicate with each other.

(3) In the invention of a third aspect according to the first or second aspect, the fluid pressure cylinder is provided to further include a first fluid supply path that communicates with the first fluid chamber through an inner side from the first piston in the radial direction and supplies the first fluid into the first fluid chamber.

(4) In the invention of a fourth aspect according to the third aspect, the fluid pressure cylinder is provided to further include an inner cylindrical portion disposed on an inner side from the housing in the radial direction; and a central rod disposed on an inner side from the inner cylindrical portion in the radial direction. The first fluid supply path is formed in the central rod, the first piston is disposed between the central rod and the inner cylindrical portion, and the second piston is disposed between the inner cylindrical portion and the housing.

(5) In the invention of a fifth aspect according to any one of the first to fourth aspects, the fluid pressure cylinder is provided in which the first fluid is a compressible fluid or an incompressible fluid, and the second fluid is a compressible fluid or an incompressible fluid.

(6) In the invention of a sixth aspect according to the first or second aspect, the fluid pressure cylinder is provided to further include a third fluid chamber that is formed on a side of the first piston which is opposite to the first fluid chamber in the axial direction and is filled with a first fluid; a first fluid supply path that supplies the first fluid into the first fluid chamber through an inner side from the first piston in the radial direction; and a second fluid supply path that supplies the first fluid into the third fluid chamber. The first piston moves in the axial direction due to a pressure difference in the first fluid between the first fluid chamber and the third fluid chamber.

(7) In the invention of a seventh aspect according to the sixth aspect, the fluid pressure cylinder is provided to further include an inner cylindrical portion disposed on an inner side from the housing in the radial direction; and a central rod disposed on an inner side from the inner cylindrical portion in the radial direction. The first fluid supply path is formed in the central rod. The first piston has a circular cylinder-shaped guide rod, which extends to a side of the second fluid chamber and pressurizes the second fluid, and is disposed between the central rod and the inner cylindrical portion. The second piston is disposed between the inner cylindrical portion and the housing.

(8) In the invention of an eighth aspect according to the seventh aspect, the fluid pressure cylinder is provided in which the third fluid chamber is disposed on an inner side from the guide rod and between the central rod and the guide rod.

(9) In the invention of a ninth aspect according to the seventh aspect, the fluid pressure cylinder is provided in which the third fluid chamber is disposed on an outer side from the guide rod and between the inner cylindrical portion and the guide rod.

According to the invention, the first piston and the second piston are disposed in the radial direction, and the surface of the first piston that pressurizes the second fluid is formed in the same direction as the surface of the second piston that receives the pressure of the second fluid. Hence, it is possible to shorten the overall length of the fluid pressure cylinder.

DETAILED DESCRIPTION OF THE INVENTION

Figures 1A, 1B, 1C, 1D:
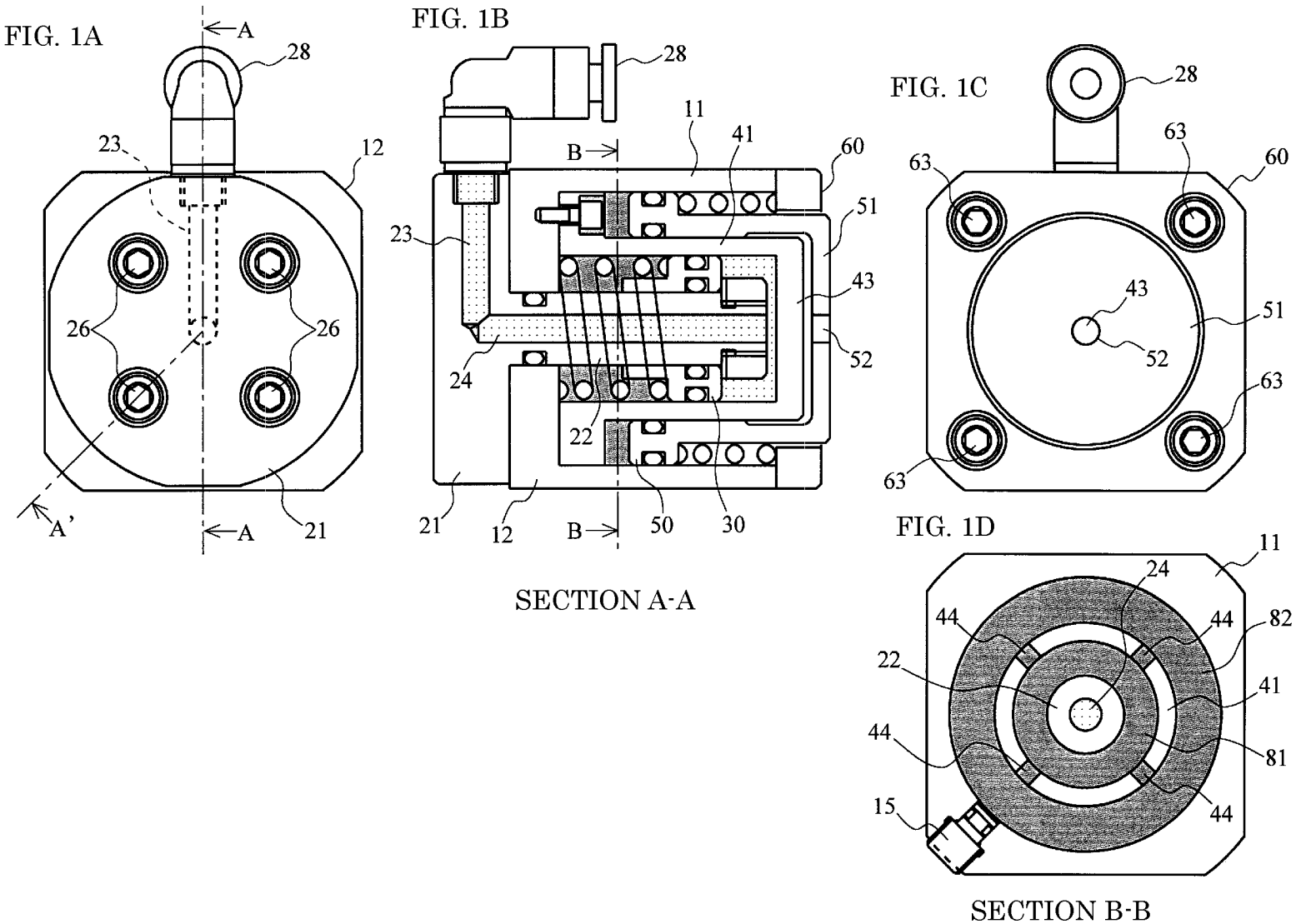
FIGS. 1A to 1D illustrate plan views and sectional views of an air hydraulic cylinder according to a first embodiment.

Hereinafter, a preferred embodiment in which a fluid pressure cylinder of the invention is applied to an air hydraulic cylinder 1 will be described in detail with reference to FIGS. 1A to 9B.

(1) Overview of Embodiments

The air hydraulic cylinder 1 of the embodiment has a double structure of cylinders in a radial direction. In other words, an inner cylinder 40 inside an outer cylinder 10 is disposed to be coaxial to an air pressure supply rod 22 inside the inner cylinder 40.

A first piston 30 is disposed between the air pressure supply rod 22 and the inner cylinder 40, a pneumatic chamber 80 is disposed on a side of one surface (hydraulic surface) of the first piston 30 in the inner cylinder 40, and a first hydraulic chamber 81 is disposed on a side of the other surface.

A second piston 50 is disposed between the outer cylinder 10 and the inner cylinder 40, and a second hydraulic chamber 82 is disposed on a side of a surface of the second piston 50 which is provided in the same direction as the hydraulic surface of the first piston 30 in both of the cylinders 10 and 40.

The inner cylinder 40 is provided with a communication hole 44 for transmitting a negative pressure along with movement of oil OL with which the first hydraulic chamber 81 and the second hydraulic chamber 82 are filled.

As described above, the first piston 30 and the second piston 50 are disposed in parallel in the radial direction, and the surfaces of both of the pistons 30 and 50, which are in contact with oil OL with which the hydraulic chambers are filled, are formed in the same direction. Hence, the fluid pressure cylinder 1 can be shortened in overall length.

(2) Details of Embodiment

Hereinafter, a first embodiment in which a fluid pressure cylinder of the invention is applied to the air hydraulic cylinder 1 will be described.

Figure 2:
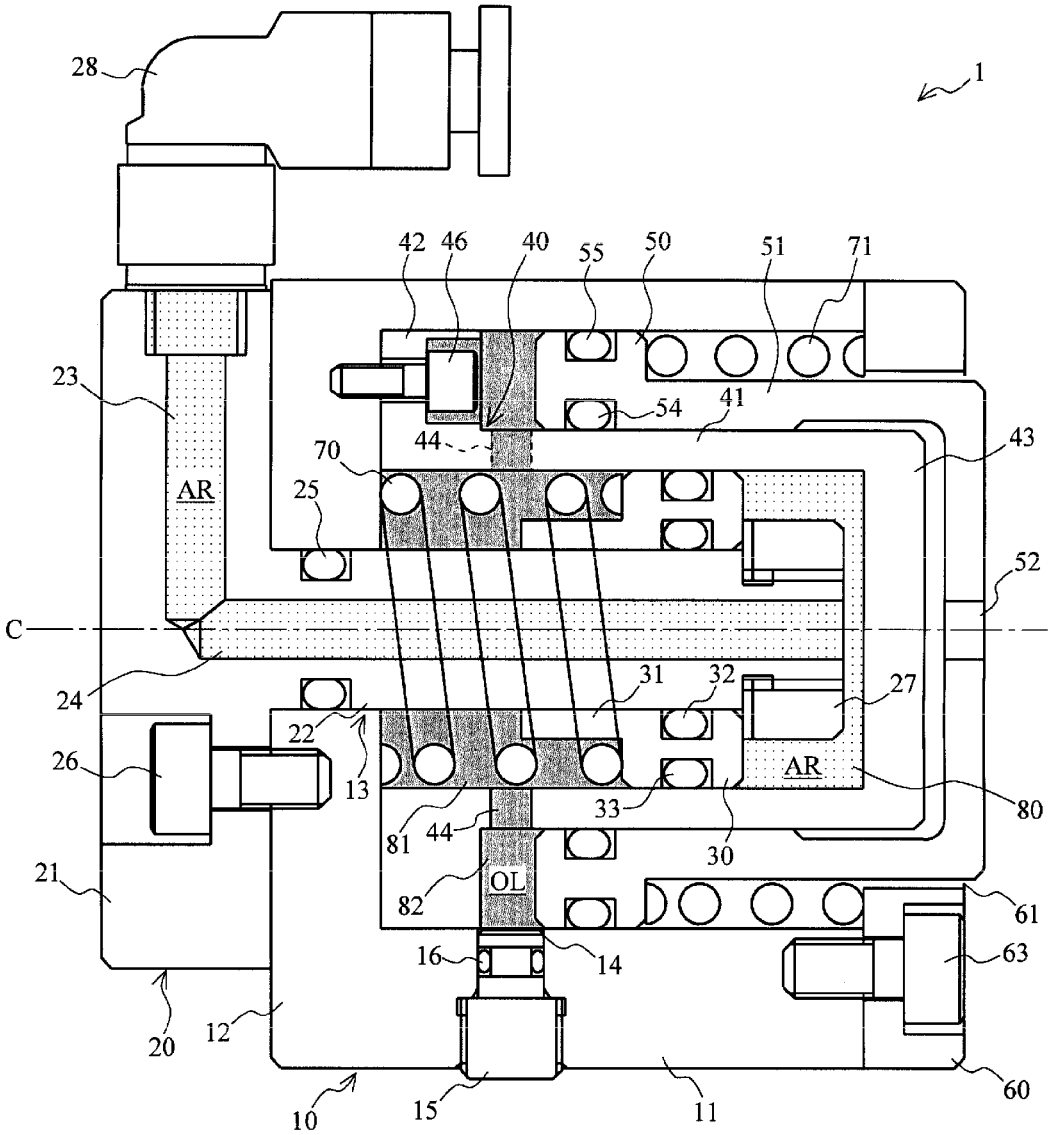
FIG. 2 illustrates a sectional view of an entire configuration of the air hydraulic cylinder.
Figure 3A:
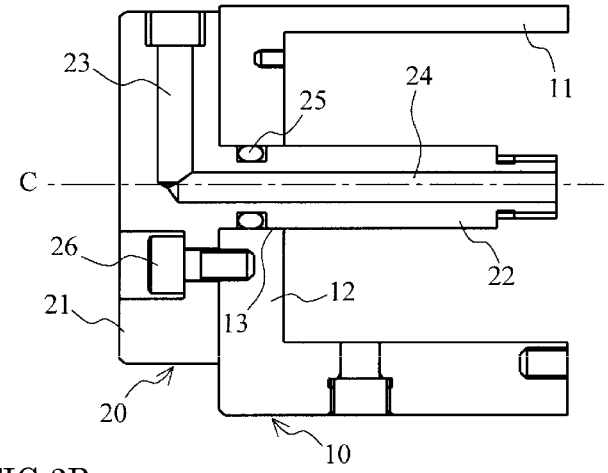
FIGS. 3A to 3C illustrate views of a part of an assembly procedure of the air hydraulic cylinder.
Figure 3B:
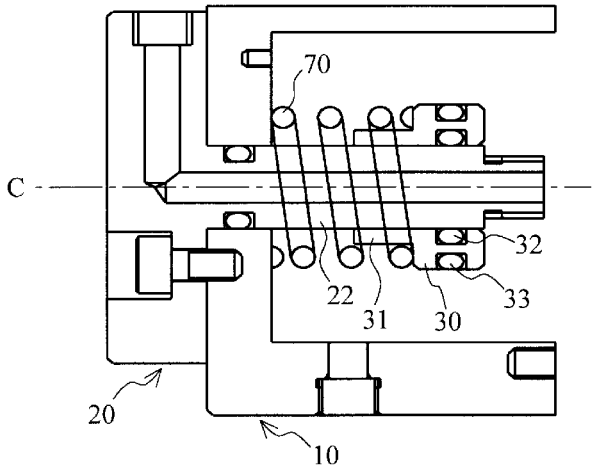
Figure 3C:
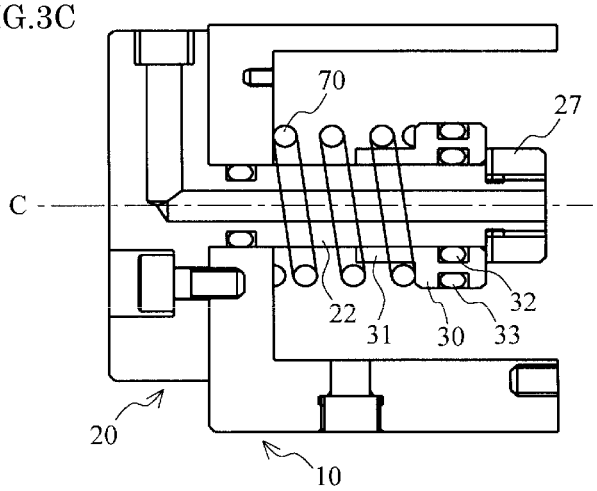

FIGS. 1A to 2 illustrate views of the air hydraulic cylinder 1 of the embodiment.

FIG. 1A is a left side view of the air hydraulic cylinder 1, FIG. 1B is a sectional view taken along sectional line A-A in the left side view in FIG. 1A, FIG. 1C is a right side view, and FIG. 1D is a sectional view taken along sectional line B-B in the sectional view in FIG. 1B.

FIG. 2 illustrates a view of section A-A' of the air hydraulic cylinder 1 according to the embodiment.

In FIG. 2 and the sectional view illustrating a section taken along line A, a pneumatic piping joint 28 is illustrated to be excluded from targets of the section.

In addition, in the following sectional views, hatched lines indicating sections of portions are omitted because it is difficult to distinguish between a leader line of a reference sign and the hatched line. However, in the views (FIGS. 2 and 6) illustrating the entire configuration, in order to clarify the distinction between the portions, halftone dots having a difference in density are used to distinguish between spaces in which supply air (air) AR and oil OL exist in the cylinders.

As illustrated in FIG. 2, the air hydraulic cylinder (fluid pressure cylinder) 1 includes the outer cylinder 10 that functions as a housing, an air pressure supply unit 20, the first piston 30, the inner cylinder 40 that functions as an inner cylindrical portion, the second piston 50, a lid 60, and coil springs 70 and 71.

The outer cylinder 10 includes an outer cylindrical unit 11 that configures a cylinder main body (housing) and an outer cylinder lid 12 disposed on one side (left side in the FIG. 2) of the outer cylindrical unit 11, and the outer cylindrical unit 11 and the outer cylinder lid 12 have the same axial core of a virtual central axis line C represented by a dot-and-dash line in FIG. 2.

As illustrated in FIG. 1D, the outer cylindrical unit 11 has the shape of the cross section orthogonal to the central axis line C, and the cross section has a circular shape on a side of an inner circumferential surface and a rectangular shape on a side of an outer circumferential surface with the corners removed.

The outer cylindrical unit 11 and the outer cylinder lid 12 of the embodiment are integrally formed; however, the outer cylindrical unit and the outer cylinder lid may be screwed with a threaded screw into inner or outer circumferential surfaces thereof, or both of the unit and the lid butted via the sealing member may be formed by being screwed.

A circular through-hole 13 is formed with the central axis line C of the outer cylinder lid 12 as the center.

The outer cylindrical unit 11 is provided with an oil supply hole 14 that penetrates through the outer cylindrical unit 11 on the same surface as a plurality of communication holes which will be described below. The oil supply hole 14 is used to fill the first hydraulic chamber 81, the second hydraulic chamber 82, and the communication holes 44 with the oil OL that functions as a second fluid.

The four communication holes 44 of the embodiment are formed as illustrated in FIG. 1D; however, one of the holes is present on line A' but is not present on line A in FIG. 1A. Hence, in FIG. 2 illustrating section A-A', the communication holes 44 positioned from line A by 45 degrees are illustrated in dotted lines. However, the halftone dots are also applied to the oil that fills the communication holes 44, which is illustrated in dotted lines. The number and disposed positions of the communication holes 44 are arbitrary, and a different number and positions may be employed.

The oil supply hole 14 is sealed with a sealing screw 15, and the sealing screw 15 includes a sealing member 16 for preventing the oil OL from flowing out from the second hydraulic chamber 82.

The sealing screw 15 may include a pressure sensor (not illustrated) for measuring a hydraulic pressure in the first hydraulic chamber 81, the communication holes 44, and the second hydraulic chamber 82.

In addition, the oil supply hole 14 and the sealing screw 15 do not need to be one set, and a plurality of sets may be provided. In this case, oil supply is performed through-holes and is not performed through at least one oil supply hole 14, and thus it is easy to supply oil because internal air is exhausted from the oil supply hole 14 through which the oil supply is not performed. Vacuuming is performed through the oil supply hole 14 through which the oil supply is not performed, and thereby it is possible to further easily perform the oil supply.

In addition, a pressure sensor is provided on one sealing screw 15 of the plurality of sets, and thereby it is possible to perform the oil supply from the other oil supply holes 14.

The air pressure supply unit 20 includes a lid 21 and the air pressure supply rod 22 that is integrally formed from the center of the lid 21. The air pressure supply rod 22 functions as a central rod.

The outer cylinder 10 and the air pressure supply unit 20 are fixed to each other with a plurality of (in the embodiment, four) bolts 26 from the lid 21 to the outer cylinder lid 12.

The air pressure supply rod 22 has a distal end provided with male threads, and a sealing nut 27 having an outer diameter larger than an outer diameter of the air pressure supply rod 22 is screwed with the threads.

The lid 21 is provided with a first air pressure supply path 23 from a side end surface (thick surface) to the central axis line C, and a second air pressure supply path 24 connected to the first air pressure supply path 23 is formed in the air pressure supply rod 22 along the central axis line C. The second air pressure supply path 24 is formed to penetrate to the distal end of the air pressure supply rod 22. The first air pressure supply path 23 and the second air pressure supply path 24 function as first fluid supply paths.

The air pressure supply rod 22 has an outer diameter that is set to be moderately smaller than an inner diameter of the through-hole 13 and is fitted therein. A sealing member (O-ring) 25 is disposed in a groove formed in the air pressure supply rod 22 along an entire circumference of a surface that is opposite to an outer circumferential surface of the air pressure supply rod 22 and an inner circumferential surface of the through-hole 13, and the sealing member 25 prevents the oil OL in the first hydraulic chamber 81 to be described below from flowing out to the outside.

The pneumatic piping joint 28 is attached to the lid 21 so as to be continuous to the first air pressure supply path 23, and thus supply air AR functioning as the first fluid is supplied from the pneumatic piping joint 28 such that the supply air is supplied through the second air pressure supply path 24 from the distal end of the first the air pressure supply rod 22 to the pneumatic chamber 80 functioning as a first fluid chamber.

The first piston 30 has the central portion provided with a guide rod 31 extending outward in a direction of the central axis line C.

A through-hole is formed in the central portion of the first piston 30 and the guide rod 31, and the air pressure supply rod 22 is slidably inserted into the through-hole. A surface of the first piston 30 on a side opposite to the guide rod 31 abuts on the sealing nut 27, and thereby the first piston is not detached from the air pressure supply rod 22.

The coil spring 70 is disposed between the air pressure supply rod 22 and the guide rod 31 and an inner circular cylindrical portion 41 to be described below, and the coil spring has an inner coil diameter larger than the diameter of the guide rod 31. One end of the coil spring 70 abuts on the outer cylinder lid 12, and the other end thereof abuts on the first piston 30.

The coil spring 70 is compressed when the first piston 30 having received the air pressure moves in a retraction direction (left direction in the figure), and the coil spring causes the first piston 30 to return to the extent that the first piston 30 abuts on the sealing nut 27 when the air pressure decreases.

An inner circumference sealing member 32 is disposed in a groove formed in the first piston 30 on a side of the inner circumferential surface thereof along an entire circumference of a surface that is opposite to an inner circumferential surface of the first piston 30 and the outer circumferential surface of the air pressure supply rod 22.

In addition, an outer circumference sealing member 33 is disposed in a groove formed in the first piston 30 on a side of the inner circumferential surface thereof along an entire circumference of a surface that is opposite to an outer circumferential surface of the first piston 30 and an inner circumferential surface of the inner circular cylindrical portion 41 to be described below.

The inner circumference sealing member 32 and the outer circumference sealing member 33 prevent the supply air AR in the pneumatic chamber 80 and the oil OL in the first hydraulic chamber 81 from flowing out to the other side thereof.

The inner cylinder 40 includes the inner circular cylindrical portion 41 in which the first piston 30 slides on the inner circumferential surface thereof, a flange 42 formed on one side (side of the air pressure supply unit 20) of the inner circular cylindrical portion 41, and a lid portion 43 formed to close the other end side of the inner circular cylindrical portion 41. The inner circular cylindrical portion 41, the flange 42, and the lid portion 43 of the embodiment are integrally formed.

A circumferential surface of the inner circular cylindrical portion 41 on the side of the flange 42 is provided with the plurality of communication holes 44 in the radial direction, through which the first hydraulic chamber 81 and the second hydraulic chamber 82 communicate with each other. The communication holes 44 are formed at positions that do not overlap with a sliding range of the first piston 30 and a sliding range of the second piston 50 (to be described below).

The inner cylinder 40 and the outer cylinder 10 are fixed to each other with a plurality of (in the embodiment, four) bolts 46 from the flange 42 to the outer cylinder lid 12. In the embodiment, attachment screw holes for the bolts 46 do not penetrate through the outer cylinder lid 12. However, in a case where the attachment screw holes for the bolts 46 are formed to penetrate through the outer cylinder lid 12, a sealing member is disposed such that the oil OL in the second hydraulic chamber 82 does not flow out from the outer cylinder lid 12.

A circular cylindrical output portion 51 is integrally formed in the second piston 50 and outputs thrust due to the oil pressure to the outside. The circular cylindrical output portion 51 is provided with a circular cylindrical portion, which is formed at the center of the second piston 50 and extends in a direction of the central axis line C, and an output plate formed to function as a lid of the circular cylindrical portion at an end portion of the circular cylindrical portion on a side opposite to the second piston 50.

The center of the output plate formed at the end portion of the circular cylindrical output portion 51 is provided with a space, which is formed from the outer circumferential surface of the inner cylinder 40, and a through-hole 52 for moving air from and to the outside.

A through-hole is formed at the central portion of the second piston 50, and the second piston 50 is slidably inserted with respect to the inner circular cylindrical portion 41.

The circular cylindrical output portion 51 is formed to have an inner diameter on the side of the second piston 50 which is the same as the inner diameter of the through-hole of the second piston 50 through the overall length of the circular cylindrical output portion, and the circular cylindrical output portion 51 slides on the outer circumferential surface of the inner circular cylindrical portion 41, thereby guiding the movement (sliding) of the second piston 50. The circular cylindrical output portion 51 is formed to have an inner diameter on a side opposite to the second piston 50 which is larger than the outer diameter of the inner circular cylindrical portion 41, thereby reducing an increase in resistance due to friction with the inner circular cylindrical portion 41.

In a case where S1 represents a projected area of a surface of end surfaces of the first piston 30 and the guide rod 31, which is in contact with the oil OL in the first hydraulic chamber 81, on a perpendicular plane to the central axis line C, and S2 represents a projected area of a surface of the second piston 50, which is in contact with the second hydraulic chamber 82, on the perpendicular plane, both projected areas are formed to satisfy a relationship of $S1<S2$.

In this manner, the second piston 50 receives thrust increased due to a hydraulic pressure higher than a pressure applied to the first hydraulic chamber 81 which is obtained when the guide rod 31 receives an air pressure from the pneumatic chamber 80 such that it is possible to output the thrust from the circular cylindrical output portion 51.

In the embodiment, the second piston 50 is disposed on an outer side of the first piston 30 with the inner circular cylindrical portion 41 interposed therein. In other words, in a case where $\delta 1$ represents a difference between the outer diameter and the inner diameter of the first piston 30, and $\delta 2$ represents the same difference in the second piston 50, both of the projected areas have a relationship of $S1<S2$ even when $\delta 1=\delta 2$, because the inner diameter of the second piston 50 is larger than the outer diameter of the first piston 30. In the embodiment, further a relationship of $\delta 1<\delta 2$ is satisfied, and thus it is possible to output larger thrust.

As illustrated in FIG. 2, the first piston 30 and the second piston 50 are not disposed in series in the direction of the central axis line C, but are disposed in parallel in the radial direction, and thereby the air hydraulic cylinder 1 can be shortened in overall length.

In the embodiment, in a state in which there is no oil pressure from the second hydraulic chamber 82 (a state in FIG. 2), the second piston 50 is positioned on a side in the retraction direction (left side in the figure) from the position of the first piston 30. In this manner, the fluid pressure cylinder 1 can be shortened in overall length.

An inner circumference sealing member 54 is disposed in a groove formed in the second piston 50 on a side of the inner circumferential surface thereof along an entire circumference of a surface that is opposite to an inner circumferential surface of the second piston 50 and the outer circumferential surface of the inner circular cylindrical portion 41.

In addition, an outer circumference sealing member 55 is disposed in a groove formed in the second piston 50 on a side of the outer circumferential surface thereof along an entire circumference of a surface that is opposite to the outer circumferential surface of the second piston 50 and the inner circumferential surface of the outer cylindrical unit 11.

The inner circumference sealing member 54 and the outer circumference sealing member 55 prevent the oil OL in the second hydraulic chamber 82 from flowing out to the outside.

The lid 60 is provided with a hole 61 into which the circular cylindrical output portion 51 of the second piston 50 is inserted, and the lid 60 is fixed to the outer cylindrical unit 11 with a plurality of bolts 63.

A coil spring 71 is disposed between the circular cylindrical output portion 51 and the outer cylindrical unit 11, and the coil spring 71 has an inner coil diameter larger than the outer diameter of the circular cylindrical output portion 51. One end of the coil spring 71 abuts on the second piston 50, and the other end thereof abuts on the lid 60.

The coil spring 71 is compressed when the second piston 50 having received the air pressure from the second hydraulic chamber 82 moves in an output direction (right direction in the figure), and the coil spring causes the second piston 50 to return to the original position when the air pressure decreases.

In the embodiment, a second fluid chamber is formed to include the first hydraulic chamber 81 that functions as the first chamber, the second hydraulic chamber 82 that functions as the second chamber, and the communication holes 44 that function as communication paths.

The outer circumferential surfaces of the air pressure supply rod 22 and the guide rod 31 are opposite to the inner circumferential surfaces of the inner circular cylindrical portion 41 and the flange 42, and the first hydraulic chamber 81 is formed by a region that is opposite to the outer cylinder lid 12 and the first piston 30.

In addition, the outer circumferential surface of the inner circular cylindrical portion 41 is opposite to the inner circumferential surface of the outer cylindrical unit 11, and the second hydraulic chamber 82 is formed by a region that is opposite to the flange 42 and the second piston 50.

Next, an assembly procedure of the air hydraulic cylinder 1 according to the embodiment will be described.

FIGS. 3A to 4F illustrate views of section A-A' of the assembly procedure of the air hydraulic cylinder 1.

The following assembly procedure (a) to (f) corresponds to FIGS. 3A to 3C and FIGS. 4D to 4F.

(a) First, the air pressure supply rod 22 of the air pressure supply unit 20, in which the sealing member 25 is set, is inserted into the through-hole 13 of the outer cylinder 10.

In a state in which the outer cylinder lid 12 abuts on the lid 21, the outer cylinder 10 and the air pressure supply unit 20 are fixed to each other with the plurality of bolts 26 from the side of the lid 21 as illustrated in FIG. 1A.

(b) Next, the air pressure supply rod 22 is inserted into the coil spring 70 from the side of the distal end of the rod and is inserted into the first piston 30 in which the inner circumference sealing member 32 and the outer circumference sealing member 33 are set.

In this case, the first piston 30 and the guide rod 31 are disposed to be positioned between the air pressure supply rod 22 and the coil spring 70.

(c) The sealing nut 27 for sealing the inserted first piston 30 is screwed through the distal end of the air pressure supply rod 22.

(d) Next, the air pressure supply rod 22, the coil spring 70, the first piston 30, and the sealing nut 27 are inserted into the inner circular cylindrical portion 41 of the inner cylinder 40 until the flange 42 abuts on the outer cylinder lid 12.

The inner cylinder 40 and the outer cylinder 10 are fixed with the plurality of bolts 46 from the side of the flange 42.

(e) Next, the inner circular cylindrical portion 41 of the inner cylinder 40 is inserted into the circular cylindrical output portion 51 and the second piston 50 in which the inner circumference sealing member 54 and the outer circumference sealing member 55 are set.

(f) Next, the circular cylindrical output portion 51 is inserted into the coil spring 71.

As illustrated in FIG. 1C, the circular cylindrical output portion 51 passes through the hole 61 of the lid 60, and the lid 60 is fixed to the outer cylinder 10 with four bolts 63.

Finally, the oil OL is injected into the second hydraulic chamber 82, the communication holes 44, and the first hydraulic chamber 81 from the oil supply hole 14 and the chambers and hole are sealed with the sealing screw 15.

The pneumatic piping joint 28 may be attached in any stage of (a) to (f).

Next, operations of the air hydraulic cylinder 1 having such a configuration will be described.

Figure 5A:
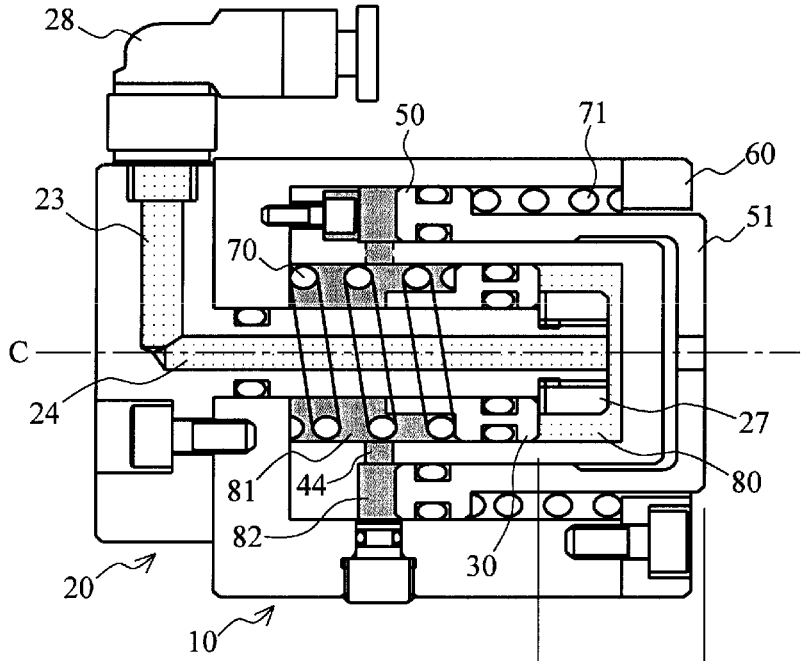
FIGS. 5A and 5B illustrate views of movement states of portions along with movement of a pneumatic piston in the air hydraulic cylinder.
Figure 5B:
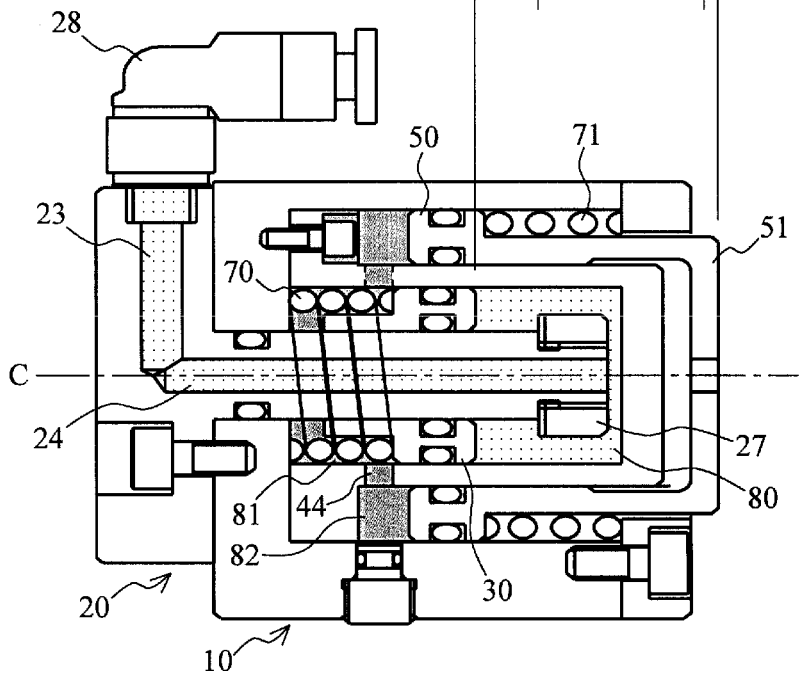

FIGS. 5A and 5B illustrate views of section A-A' of states obtained before and after an operation of the air hydraulic cylinder 1.

The air hydraulic cylinder 1 illustrated in FIG. 5A is in a state in which the circular cylindrical output portion 51 is positioned to be closest to the side of the air pressure supply unit 20. In this state, as illustrated in FIG. 5A, the first piston 30 is in a state of abutting on the sealing nut 27 due to a spring force of the coil spring 70, and the second piston 50 is in a state of being most retracted due to a spring force of the coil spring 71. Hereinafter, a position obtained in a state (state in FIG. 5A) into which the portions of the air hydraulic cylinder 1 enter is set to a start position.

In addition, the first piston 30 and the second piston 50, which are actuating members disposed in the air hydraulic cylinder 1, are disposed to be coaxial to the center of the central axis line C and both move in the axial direction. Hereinafter, a direction (right direction in FIG. 5A), in which the second piston 50 moves from the start position along the central axis line C, will be referred to as an output direction, and the reverse direction (left direction in FIG. 5A) thereof will be referred to as a retraction direction in the description.

When the supply air AR is supplied from the pneumatic piping joint 28, the pneumatic chamber 80 is pressurized through the first air pressure supply path 23 and the second air pressure supply path 24.

In the embodiment, as described above, the first piston 30 is disposed on the outer side in the radial direction from the air pressure supply rod 22 that supplies the supply air AR to the pneumatic chamber 80. In other words, the air pressure supply rod 22 and the first piston 30 are not disposed in series in the direction of the central axis line C, but are disposed in parallel in the radial direction.

In this manner, the supply air AR is supplied into the pneumatic chamber 80 from the air pressure supply rod 22 in the output direction, and thereby the air pressure is applied to the first piston 30 from the pneumatic chamber 80 in the retraction direction.

Hence, when the air pressure in the pneumatic chamber 80 exceeds the spring force of the coil spring 70, the first piston 30 moves in the retraction direction while compressing the coil spring 70 with the air pressure.

When the first piston 30 moves in the retraction direction, the first hydraulic chamber 81 decreases in volume, and thereby the oil OL in the first hydraulic chamber 81, the communication holes 44, and the second hydraulic chamber 82 is pressurized. When the oil pressure of the pressurized oil OL exceeds the spring force of the coil spring 71, the second piston 50 moves in the output direction due to the hydraulic pressure.

As described above, in the embodiment, since a surface of the first piston 30 on the side of the first hydraulic chamber 81 is formed in the same direction as that of a surface of the second piston 50 on the side of the second hydraulic chamber 82, the second piston 50 moves in a direction reverse to the moving direction of the first piston 30.

In the embodiment, as described above, since the projected area S2 of the second piston 50 is larger than the projected area S1 of the first piston 30 (S1<S2), the second piston 50 receives the hydraulic pressure amplified by S2/S1 times in the output direction.

In addition, as described above, the second piston 50 is disposed on the outer side from the first piston 30 in the radial direction. In other words, the first piston 30 and the second piston 50 are not disposed in series in the direction of the central axis line C, but are disposed in parallel in the radial direction.

In this manner, the second piston 50 moves in a direction reverse to the first piston 30 moving in the retraction direction due to the air pressure from the pneumatic chamber 80, that is, in the output direction due to the hydraulic pressure amplified from the second hydraulic chamber 82, and thus the large thrust is output from the circular cylindrical output portion 51.

FIG. 5B illustrates a state in which the first piston 30 receives the air pressure from the pneumatic chamber 80 and moves to the largest extent in the retraction direction (moves to the maximum stroke width).

When the first piston 30 moves by the maximum stroke width (pneumatic stroke), the coil spring 70 is compressed and the first hydraulic chamber 81 has the minimum volume. Then, the oil OL moves to the second hydraulic chamber 82 from the communication holes 44 by an amount corresponding thereto.

Since the relationship of the projected areas is S1<S2 as described above, the first piston 30 moves by the pneumatic stroke, and thereby the second piston 50 and the circular cylindrical output portion 51 move by a hydraulic stroke, as illustrated in FIG. 5B. In this state, the large thrust is output from a plate-shaped portion of the distal end of the circular cylindrical output portion 51 due to the oil pressure amplified in the output direction.

Next, an operation performed during the retraction of the second piston 50 will be described.

In the state in FIG. 5B, when the pressure of the supply air AR that is supplied from the pneumatic piping joint 28 decreases, the first piston 30 moves in the direction (output direction) of the sealing nut 27 by the compressed coil spring 70.

Along with the movement of the first piston 30, the first hydraulic chamber 81 increases in volume and the hydraulic pressure in the entire hydraulic chamber decreases. In this manner, the second piston 50 moves in the retraction direction by the compressed coil spring 71.

When the first piston 30 abuts on the sealing nut 27 and returns to the start position, the second piston 50 returns to its start position.

As described above, In the embodiment, in a retraction operation of returning from the state in FIG. 5B to the state in FIG. 5A, the first piston 30 and the second piston 50 return to the start positions due to the spring forces of the compressed coil springs 70 and 71, respectively.

Next, a second embodiment of the air hydraulic cylinder 1 will be described.

In the first embodiment described above, a case where a so-called single-acting type air hydraulic cylinder 1, that is, one system for output as a flow path of the supply air AR acting on the first piston 30, is provided, and the coil spring 70 is used for the retraction of the first piston 30 is described.

By comparison, the air hydraulic cylinder 1 of the second embodiment is a so-called double-acting type air hydraulic cylinder 1, and two systems for output and retraction may be provided as the flow path of the supply air AR acting on the first piston 30.

Figure 6:
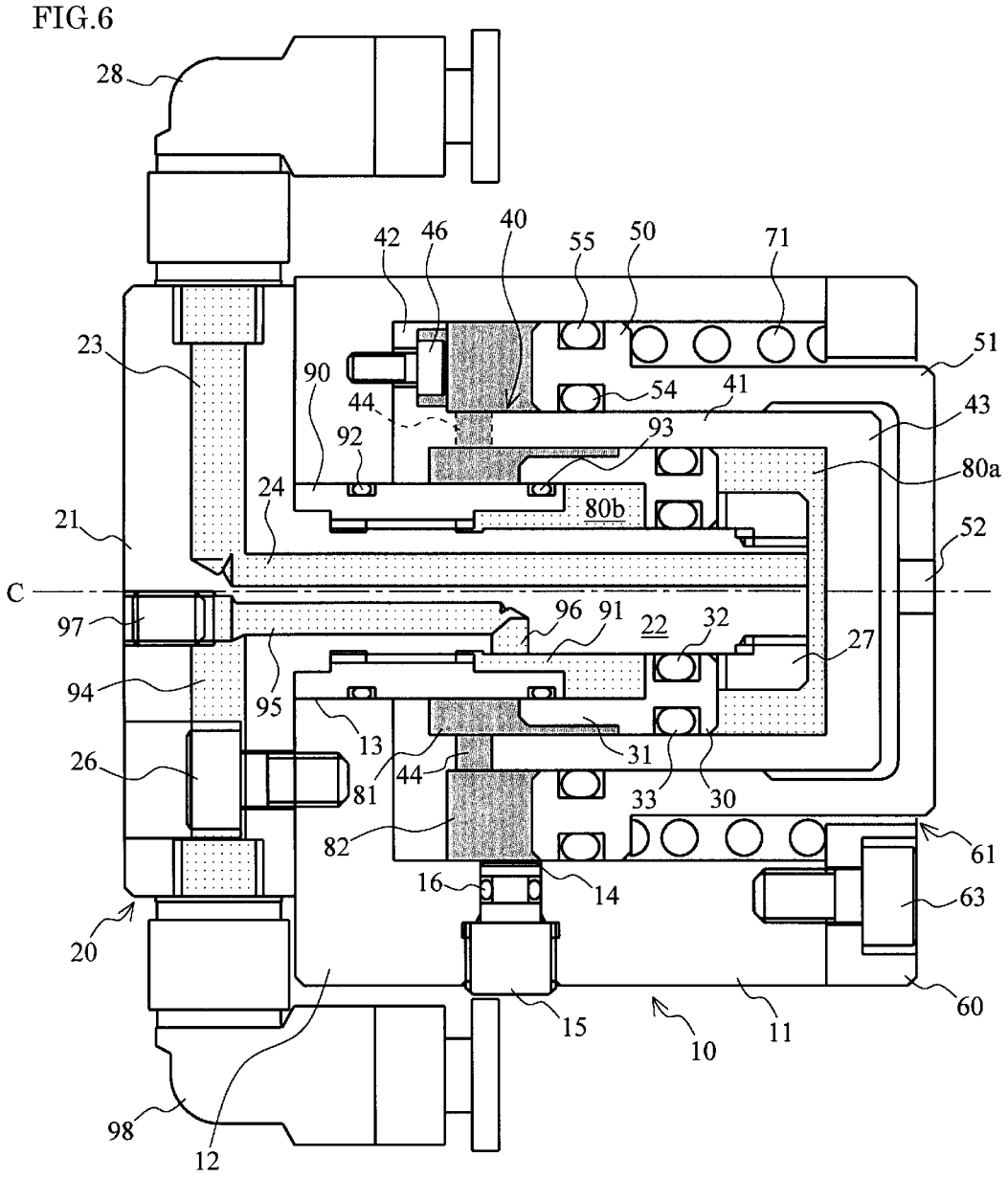
FIG. 6 illustrates a sectional view of an entire configuration of an air hydraulic cylinder according to a second embodiment.

FIG. 6 illustrates a sectional view of an entire configuration of an air hydraulic cylinder according to the second embodiment.

In FIG. 6, the same reference signs are assigned to the same portions as those in the first embodiment, and thus the description thereof is appropriately omitted. Hereinafter, the description is provided by focusing on differences.

In addition, FIG. 6 illustrates not section A-A, but section A-A' for simple comparison to the first embodiment 1. Therefore, since systems of the supply air AR for backward flowing (a third air pressure supply path 94 to a fifth air pressure supply path 96), which are present on line A-A' do not appear on the cross section, it is possible to illustrate the systems in dotted lines. However, it is difficult to view the figure, and thus the systems are illustrated in solid lines for convenience.

Similar to the first embodiment, the pneumatic piping joint 28 and a pneumatic piping joint 98 are excluded from the targets of the cross section.

In the embodiment, a pneumatic chamber 80*b* for moving the first piston 30 in the output direction is provided on a side opposite to a pneumatic chamber 80*a*, as well as the pneumatic chamber 80*a* for moving the first piston 30 in the retraction direction (left side on the figure).

The pneumatic chamber 80*a* functions as a pneumatic chamber for forward movement which causes the first piston 30 to move in the retraction direction and to cause the second piston 50 to move in the output direction in a reciprocal operation and the pneumatic chamber 80*b* functions as a pneumatic chamber for backward movement.

In the embodiment, since the systems of the supply air AR and the pneumatic chamber 80*b* for the backward movement are provided, the coil spring 70 that is employed in the first embodiment is not employed.

In order to form the pneumatic chamber 80*b*, the first piston 30 of the embodiment is formed such that the inner diameter of the guide rod 31 is larger than the outer circumference of the air pressure supply rod 22. In this manner, on a surface of the first piston 30 opposite to the pneumatic chamber 80*a*, a surface that abuts on the pneumatic chamber 80*b* is formed as well as a surface that configures the first hydraulic chamber 81.

In addition, an intermediate cylinder 90 has an outer diameter that is the same as the inner diameter of the guide rod 31 and has an outer circumferential surface of a part of the end portion, which abuts on the inner circumferential surface of the guide rod 31 on the distal end. The intermediate cylinder is disposed in a state in which one end of the intermediate cylinder 90 abuts on the lid 21 of the air pressure supply unit 20.

Female threads are threaded to the inner circumferential surface on one side of the intermediate cylinder 90 and are screwed with a male screw threaded on the outer circumference of the air pressure supply rod 22 on the side of lid 21.

The inner diameter of the intermediate cylinder 90 to the female screw from the other end side is formed to be larger than the air pressure supply rod 22, and thereby a gap 91 is formed along the entire circumference between the air pressure supply rods 22. The supply air AR is supplied to the pneumatic chamber 80*b* from the fifth air pressure supply path 96 to be described below via the gap 91.

A sealing member 93 is disposed in a groove formed in the intermediate cylinder 90 on a side of the outer circumferential surface thereof along the entire circumference of a surface that is opposite to the outer circumferential surface of the intermediate cylinder 90 and the inner circumferential surface of the guide rod 31. The sealing member 93 prevents the supply air AR in the pneumatic chamber 80*b* and the oil OL in the first hydraulic chamber 81 from flowing out to the sides thereof.

In addition, a sealing member 92 is disposed in a groove formed on the side of the intermediate cylinder 90 along the entire circumference of a surface that is opposite to an inner circumferential surface of the intermediate cylinder 90 and an inner circumferential surface of the through-hole 13 of the outer cylinder lid 12, and the sealing member prevents the oil OL in the first hydraulic chamber 81 from flowing out to the outside. The sealing member 92 corresponds to the sealing member 25 in the first embodiment.

In the embodiment, as a system that supplies the supply air AR for backward movement to the pneumatic chamber 80*b*, the third air pressure supply path 94, a fourth air pressure supply path 95, and a fifth air pressure supply path 96 are formed in the air pressure supply unit 20.

In other words, the lid 21 is provided with the third air pressure supply path 94 from a side end surface (thick surface) to the central axis line C, and the fourth air pressure supply path 95 connected to the third air pressure supply path 94 is formed in the air pressure supply rod 22 along the central axis line C. The fourth air pressure supply path 95 is formed from the side of the lid 21 to a position of the gap 91 between the air pressure supply rod 22 and the intermediate cylinder 90 that form the pneumatic chamber 80*b*. A plug 97 is screwed to the fourth air pressure supply path 95 so as to block an open portion on the side of the lid 21.

Further, the air pressure supply rod 22 has, from the outer circumferential surface thereof, the fifth air pressure supply path 96 that communicates with the distal portion of the fourth air pressure supply path 95.

The second air pressure supply path 24 according to the first embodiment is formed along the central axis line C; however, in the embodiment, since it is necessary to form both systems for the forward path and backward path in the air pressure supply rod 22, the second air pressure supply path 24 and the fourth air pressure supply path 95 are formed on the outer side from the central axis line C so as not to interfere with each other.

Similar to the pneumatic piping joint 28, the pneumatic piping joint 98 is attached to the circumferential surface of the lid 21 in the air pressure supply unit 20 so as to be connected to the third air pressure supply path 94. The supply air AR for backward movement is supplied from the pneumatic piping joint 98 to the pneumatic chamber 80*b* from the circumferential surface of the air pressure supply rod 22 through the third air pressure supply path 94, the fourth air pressure supply path 95, and the fifth air pressure supply path 96.

Next, an assembly procedure of the air hydraulic cylinder 1 according to the second embodiment will be described.

Figure 7A:
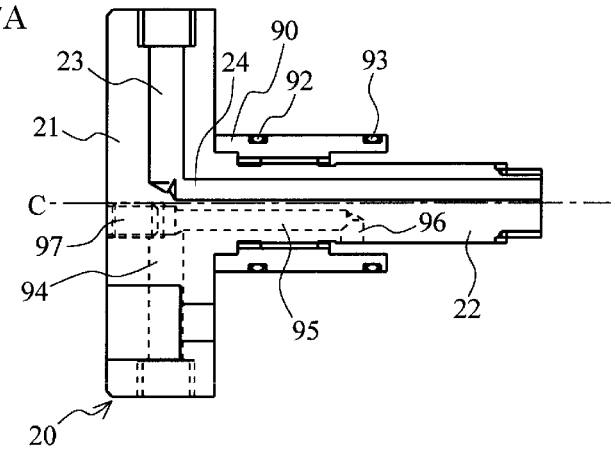
FIGS. 7A to 7C illustrate views of a part of an assembly procedure of the air hydraulic cylinder.
Figure 7B:
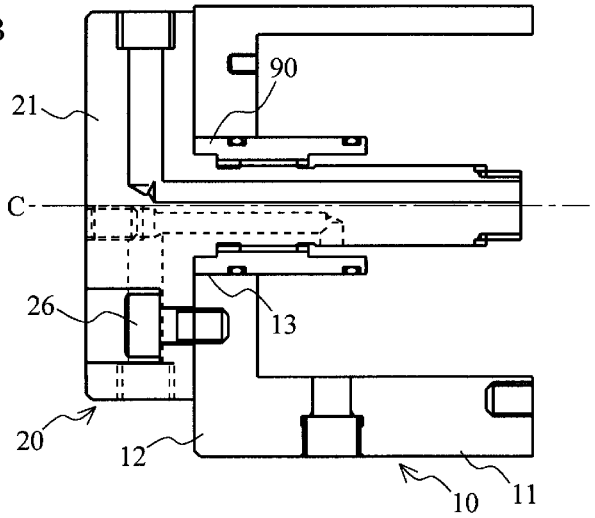
Figure 7C:
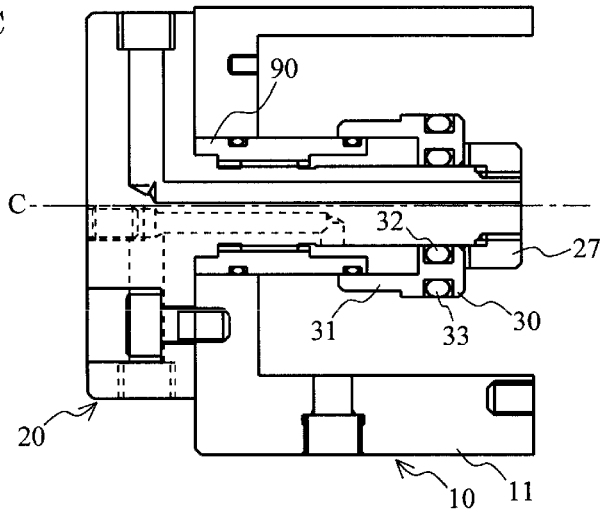

FIGS. 7A to 7C illustrate views of section A-A' in a part of an assembly procedure of the air hydraulic cylinder 1.

The following assembly procedure (a) to (c) corresponds to FIGS. 7A to 7C.

(a) First, the intermediate cylinder 90, in which the sealing members 92 and 93 are set, is screwed to the air pressure supply rod 22 of the outer cylinder 10, until the intermediate cylinder 90 abuts on the lid 21.

(b) Next, the intermediate cylinder 90 is inserted into the through-hole 13 of the outer cylinder 10.

In a state in which the outer cylinder lid 12 abuts on the lid 21, the outer cylinder 10 and the air pressure supply unit 20 are fixed to each other with the plurality of bolts 26 from the side of the lid 21.

(c) Next, until the intermediate cylinder 90 enters the guide rod 31, the air pressure supply rod 22 is inserted into the first piston 30 in which the inner circumference sealing member 32 and the outer circumference sealing member 33 are set.

The sealing nut 27 for sealing the inserted first piston 30 is screwed to the distal end of the air pressure supply rod 22.

Hereinafter, although not illustrated, the assembly is performed in the same manner as the assembly procedure (d) to (f) in the first embodiment illustrated in FIGS. 4D to 4F.

In other words, (d) the inner cylinder 40 is set, (e) the second piston 50 and the circular cylindrical output portion 51 are set, and (f) the lid 60 is set, the pneumatic piping joints 28 and 98 are set, and the injecting and sealing of the oil OL are performed.

Next, operations of the double-acting type air hydraulic cylinder 1 having such a configuration will be described.

Figure 8A:
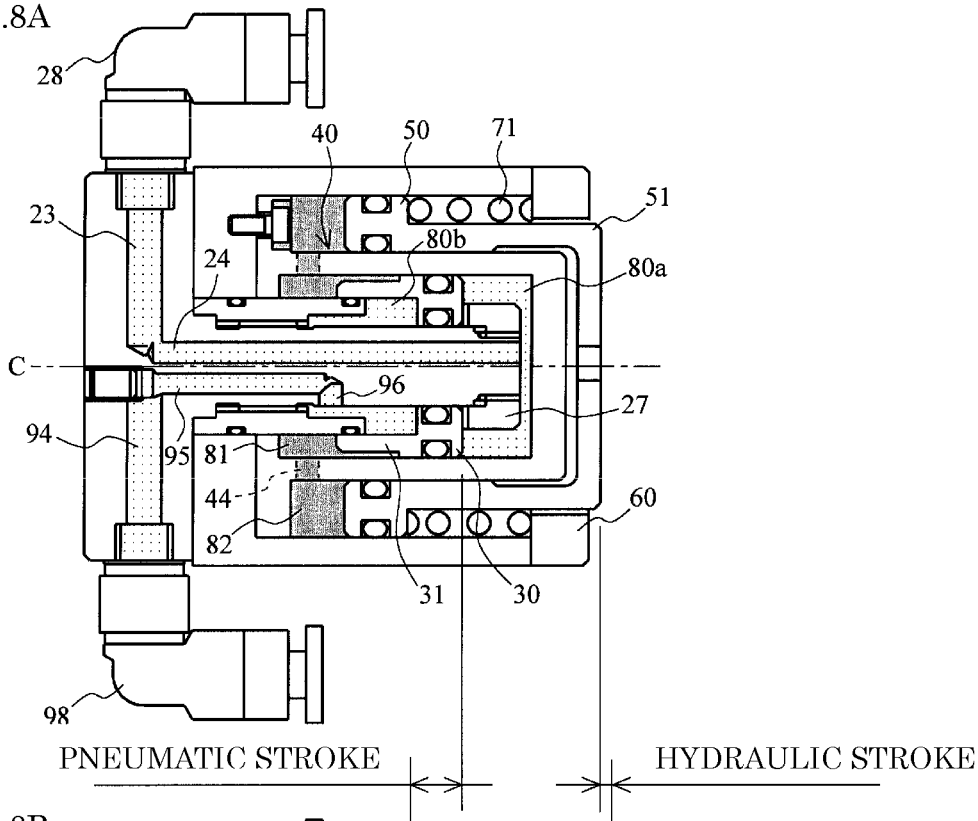
FIGS. 8A and 8B illustrate views of movement states of portions along with movement of a pneumatic piston in the air hydraulic cylinder.
Figure 8B:
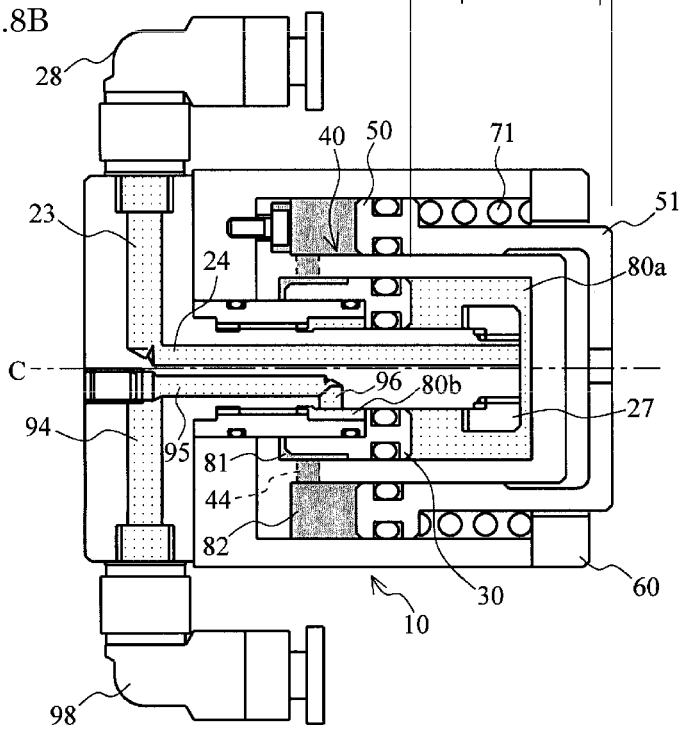

FIGS. 8A and 8B illustrate views of section A-A of states obtained before and after an operation of the double-acting type air hydraulic cylinder 1.

In a case where the first piston 30 moves onward in the retraction direction, the supply air AR is supplied from the pneumatic piping joint 28 to the pneumatic chamber 80*a* via the first air pressure supply path 23 and the second air pressure supply path 24 in a start state in FIG. 8A. In this case, the supply air AR in the pneumatic chamber 80*b* flows out to the outside from the pneumatic piping joint 98 via the fifth air pressure supply path 96, the fourth air pressure supply path 95, and the third air pressure supply path 94.

As described above, when the supply air AR is supplied to the pneumatic chamber 80*a*, the first piston 30 is pushed by the supply air AR of the pneumatic chamber 80*a* and moves in the retraction direction, and the first hydraulic chamber 81 decreases in volume.

The first hydraulic chamber 81 decreases in volume. In this manner, similar to the description in the first embodiment, the hydraulic pressure of the second hydraulic chamber 82 is amplified such that the second piston 50 and the circular cylindrical output portion 51 move in the output direction, and the state in FIG. 8B is obtained.

On the other hand, in a case where the second piston 50 and the circular cylindrical output portion 51 are retracted from the state illustrated in FIG. 8B, the supply air AR is supplied from the pneumatic piping joint 98 to the pneumatic chamber 80*b* via the third air pressure supply path 94, the fourth air pressure supply path 95, and the fifth air pressure supply path 96. In addition, the supply air AR in the pneumatic chamber 80*a* flows out to the outside from the pneumatic piping joint 28 via the second air pressure supply path 24 and the first air pressure supply path 23.

When the supply air AR is supplied to the pneumatic chamber 80*b*, the pressure on the side of the pneumatic chamber 80*b* is higher than the side of the pneumatic chamber 80*a* due to the supply pressure, the first piston 30 moves in the output direction (right side on the figure), and the volume of the second hydraulic chamber 82 returns to the original size. In this manner, the hydraulic pressure of both of the second piston 50 and the circular cylindrical output portion 51 decreases, and thereby the portions return to the start position.

Next, a third embodiment will be described.

In the first embodiment, a case where the outer cylinder lid 12 and the flange 42 are fixed to each other with the bolts 46 from the flange 42 is described; however, in the embodiment, the fixing is performed from the outer cylinder lid 12.

Figure 9A:
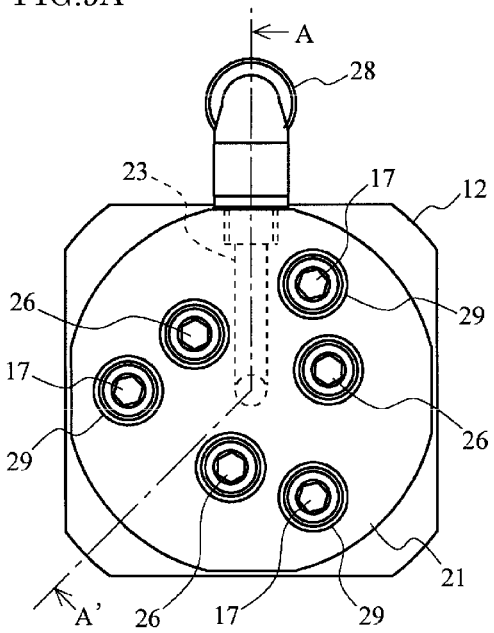
FIGS. 9A and 9B illustrate a side view and a sectional view of an air hydraulic cylinder according to a third embodiment.
Figure 9B:
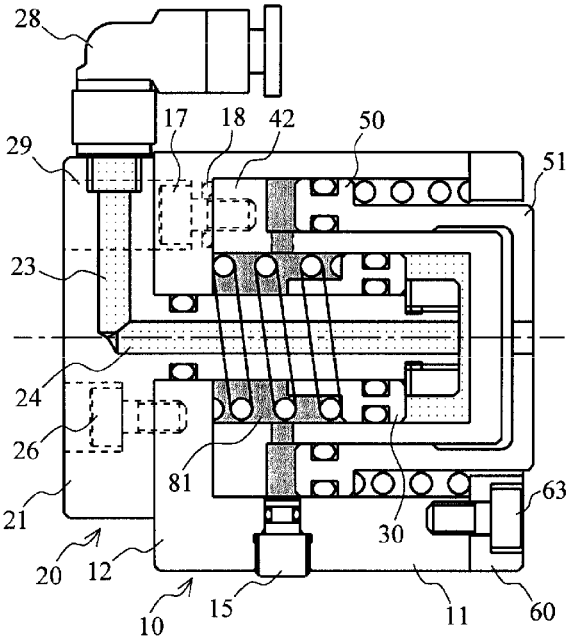

FIGS. 9A and 9B illustrate a side view of the air hydraulic cylinder 1 according to the third embodiment and illustrate a view of A-A' section.

In the embodiment, as illustrated in FIG. 9B, the outer cylinder lid 12 and the flange 42 are fixed with a plurality of bolts 17 from the side of the outer cylinder lid 12.

In order to perform fixing with the bolts 17, the lid 21 of the air pressure supply unit 20 is provided with through-holes 29 at positions corresponding to the bolts 17.

In the embodiment, as illustrated in FIG. 9A, the three bolts 17 and the three bolts 26 for fixing the lid 21 of the air pressure supply unit 20 and the outer cylinder lid 12 are provided, and phases of the three points on a coaxial circle vary and are disposed. This is because the bolts 17 and the bolts 26, and the bolts 17 and 26 and the first air pressure supply path 23 do not interfere with each other.

In the embodiment, since the bolts 17 are fixed through the outer cylinder lid 12 from the side of the lid 21, the sealing member 18 is disposed in the bolts 17 such that the oil OL in the first hydraulic chamber 81 does not flow out.

Figure 4D:
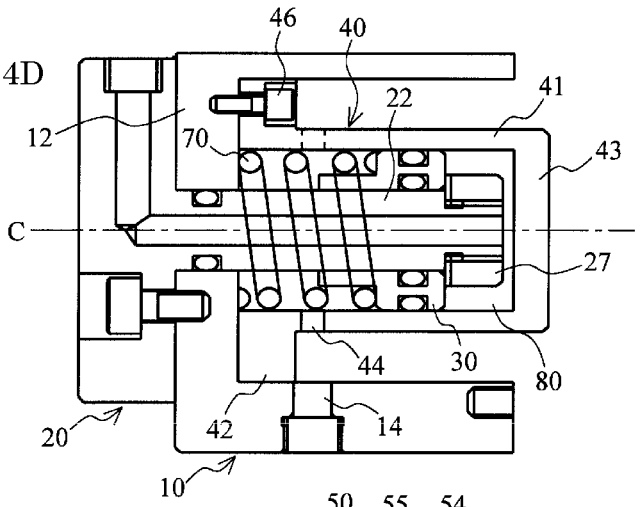
FIGS. 4D to 4F illustrate views of the rest of the assembly procedure of the air hydraulic cylinder.
Figure 4E:
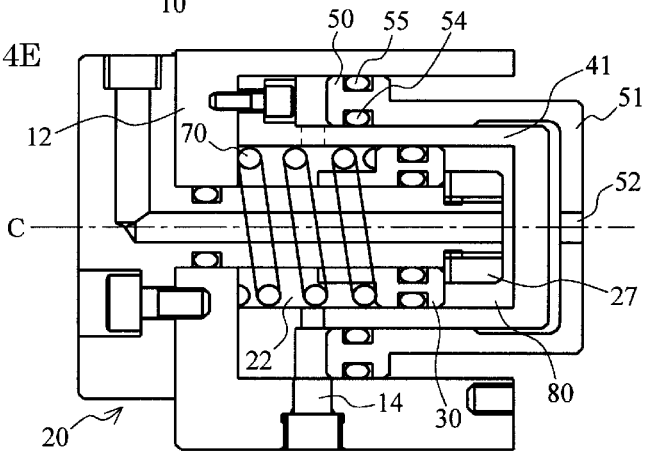
Figure 4F:
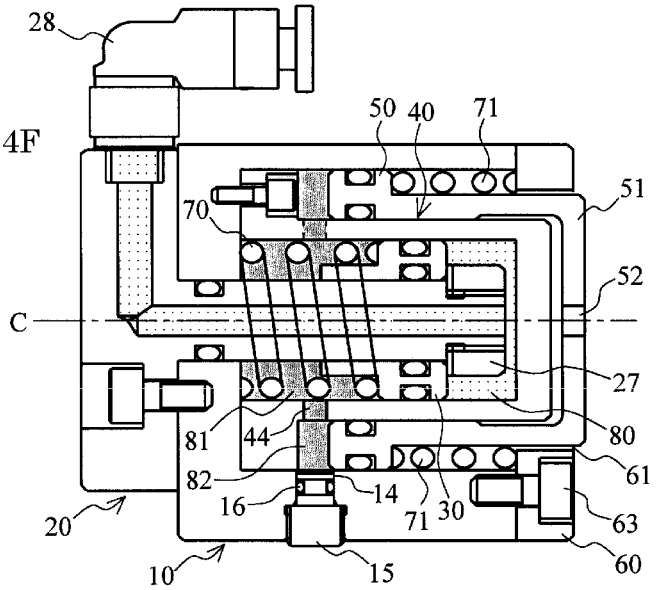

As the procedure of the assembly of the air hydraulic cylinder 1 of the embodiment, a bolt 18 is first set in a recessed portion formed in the outer cylinder lid 12 in a process illustrated in FIG. 4D. Then, in a state in which the air pressure supply rod 22 or the like is inserted into the inner circular cylindrical portion 41 of the inner cylinder 40, and the outer cylinder lid 12 and the flange 42 abut on each other, the outer cylinder lid 12 is fixed with the bolts 17 from the side of the lid 21. The other processes before and after the process are the same as the first embodiment.

According to the embodiment, since there is an extra region compared to a case where the bolt 46 is fixed between the outer cylindrical unit 11 and the inner circular cylindrical portion 41, the bolts 26 and the bolts 17 can have the same standard.

As the third embodiment, a case where orientations of the bolts that fix the outer cylinder lid 12 and the flange 42 in the single-acting type air hydraulic cylinder 1 of the first embodiment is described; however, it is also possible to apply the same configuration to the double-acting type air hydraulic cylinder 1 of the second embodiment.

In a case where the third embodiment is applied to the double-acting type air hydraulic cylinder 1, positions of the third air pressure supply path 94 and the pneumatic piping joint 98 are changed to positions so as not to interfere with both of bolts 17 and 26. Alternatively, the positions of both of the bolts 17 and 26 are changed to a position different from the third embodiment.

According to the embodiment described above, the fluid pressure cylinder 1 can be shortened in overall length.

In other words, compared to the air hydraulic cylinder 1 of the related art in which two types of fluid chambers are configured to move in series or in the same direction, and thus the length of the entire cylinder is determined by adding the stroke lengths of the two types of fluid chambers, the two types of fluid chambers are disposed in parallel in the radial direction with respect to the central axis line C, and thus the cylinder can be shortened in overall length without adding the strokes of the fluid chambers.

In addition, the two types of fluid chambers are configured to have opposite piston operating directions, and thus it is possible to easily dispose the fluid chambers in the radial direction such that the cylinder can be shortened in overall length.

The technical scope of the invention is not limited to the embodiments described above, and it is possible to perform various modifications within a range without departing from the gist of the invention.

For example, in the embodiment, a case where the outer cylinder 10 and the air pressure supply unit 20 are separately formed and both are fixed with the bolts 26 is described.

In this respect, the outer cylinder 10 and the air pressure supply unit 20 may be integrally formed. In this case, there is no need to use the outer cylinder lid 12, the sealing member 25, and the bolts 26, and the outer cylindrical unit 11 is integrally formed from the lid 21 so as to extend in the same direction as the air pressure supply rod 22.

The outer cylinder 10 and the air pressure supply unit 20 are integrally formed, and thereby there is no need to have a thickness of an amount of the outer cylinder lid 12. Therefore, assembly processes to be described below are shortened in time, and it is possible to further shorten the length in a length direction (direction of the central axis line C).

In addition, in the embodiment described above, a case where an internal fluid, with which the first hydraulic chamber 81, the communication holes 44, and the second hydraulic chamber 82 are filled, is the oil OL is described; however, the fluid for filling is not limited to the oil OL, and it is preferable that the fluid is an incompressible fluid. Since it is possible to prevent a part of thrust from being consumed in compression of the fluid by using an oil of the incompressible fluid, it is possible to generate large thrust in the second piston 50 and the circular cylindrical output portion 51 with high efficiency.

In addition, not only the pneumatic chamber 80, but also the first hydraulic chamber 81, the communication holes 44, and the second hydraulic chamber 82 may be filled with a compressible fluid such as air. Also in this case, the pneumatic cylinder can be shortened in length.

Further, not only the first hydraulic chamber 81, the communication holes 44, and the second hydraulic chamber 82, but also the pneumatic chamber 80 may be filled with an incompressible fluid such as the oil OL.

In addition, in the embodiment described above, a case of using one coil spring 70 having the diameter that is large to the extent that the air pressure supply rod 22 and the guide rod 31 can be inserted into the coil spring 70 and one coil spring 71 having the diameter that is large to the extent that the circular cylindrical output portion 51 can be inserted into the coil spring 71 is described; however, a plurality of coil springs 70 and 71 having a small outer diameter may be arranged.

In this case, the coil springs 70 and 71 having the small outer diameter are arranged at equal intervals on the circumference on which one coil spring 70 and one coil spring 71 described above in the embodiment are disposed. Six coil springs 70 and six coil springs 71 having the small outer diameter are arranged in a modification example; however, the number of coil springs may not be limited as long as two or more coil springs are provided. In addition, the number of the coil springs 70 and the coil springs 71 having the small outer diameter may be the same or be different from each other.

The coil springs 70 having the small outer diameter have an outer diameter that is smaller than a gap between the guide rod 31 and the inner circular cylindrical portion 41. In addition, the coil springs 71 having the small outer diameter have an outer diameter that is smaller than a gap between the circular cylindrical output portion 51 and the outer cylindrical unit 11.

In the embodiment (and modification example described above) described above, a case where both of the coil spring 70 and the coil spring 71 are disposed is described; however, any one of both springs may be disposed.

The coil springs 70 and 71 play a role of returning the first piston 30 and the second piston 50 to the start position.

Therefore, in a case where only the coil spring 70 is disposed, the oil OL in the first hydraulic chamber 81 increases, and the oil OL in the second hydraulic chamber 82 decreases when the first piston 30 moves in the output direction (right direction in FIG. 2) by the coil spring 70. As a result, the second piston 50 is linked with the first piston 30 and is returned to the original position (start position).

On the other hand, in a case where only the coil spring 71 is disposed, the oil OL in the second hydraulic chamber 82 decreases, and the oil OL in the first hydraulic chamber 81 increases when the second piston 50 moves in the retraction direction (left direction in FIG. 2) by the coil spring 71. As a result, the second piston 50 is linked with the first piston 30 and is returned to the original position (start position).

As described in the embodiment, in the case where both of the coil springs 70 and 71 are disposed, it is possible to rapidly perform the operation of returning to the start position.

On the other hand, since the thrust during the output is canceled due to the spring force, it is possible to dispose only one of the coil springs 70 and 71, and thereby it is possible to reduce an amount of a decrease in the thrust due to the cancellation.

For example, in a case where sliding resistance is high by the sealing members 32, 33, 54, and 55 disposed in the first piston 30 and the second piston 50, both of the coil springs 70 and 71 are disposed such that both of the pistons 30 and 50 smoothly move. In a case where the sliding resistance is relatively low, it is possible to dispose any one coil spring.

Next, the air hydraulic cylinder 1 according to a fourth embodiment will be described with reference to FIGS. 10 to 13.

Incidentally, in the second embodiment (FIGS. 6 to 8), the so-called double-acting type air hydraulic cylinder 1 that includes two systems for the output and the retraction which are provided as flow paths of the supply air AR that acts on the first piston 30 is described.

In the air hydraulic cylinder 1 of the second embodiment, a case where the guide rod 31 is formed in the first piston 30; however, the guide rod 31 is formed to have the inner diameter larger than the inner diameter of the first piston 30 through which the air pressure supply rod 22 penetrates, and thereby the pneumatic chamber 80*b* (functioning as a third fluid chamber) is formed between the guide rod 31 and the air pressure supply rod 22 on the inner side from the guide rod 31 is described.

The fourth embodiment employs the double-acting type air hydraulic cylinder 1; however, the cylinder is different from that in the second embodiment, the guide rod 31 has the inner diameter that is the same as the inner diameter of the first piston 30, that is, the guide rod 31 is formed to have the same size as the diameter of the air pressure supply rod 22, and the pneumatic chamber 80*b* (functioning as the third fluid chamber) is formed between the guide rod 31 and the inner cylinder 40 on the outer side from the guide rod 31.

In this manner, it is possible to reduce the projected area S1 of the distal end of the guide rod 31 in the first hydraulic chamber 81.

Therefore, according to the fourth embodiment, compared to the second embodiment, it is possible to increase Sa/s1 or S2/S1 with respect to a projected area Sa of the first piston 30 in the pneumatic chamber 80*a* and the projected area S2 of the second piston 50 in the second hydraulic chamber 82. In other words, it is possible to output a higher output pressure (thrust) from the circular cylindrical output portion 51, compared to the pressure of the supply air AR of the first hydraulic chamber 81*a*.

In the second embodiment, compared to the fourth embodiment, since the forward and backward systems (the second air pressure supply path 24, the fourth air pressure supply path 95, and the like) of the supply air AR are all accommodated in the air pressure supply rod 22, it is possible to reduce the size of the air hydraulic cylinder 1 in the radial direction.

Figure 10:
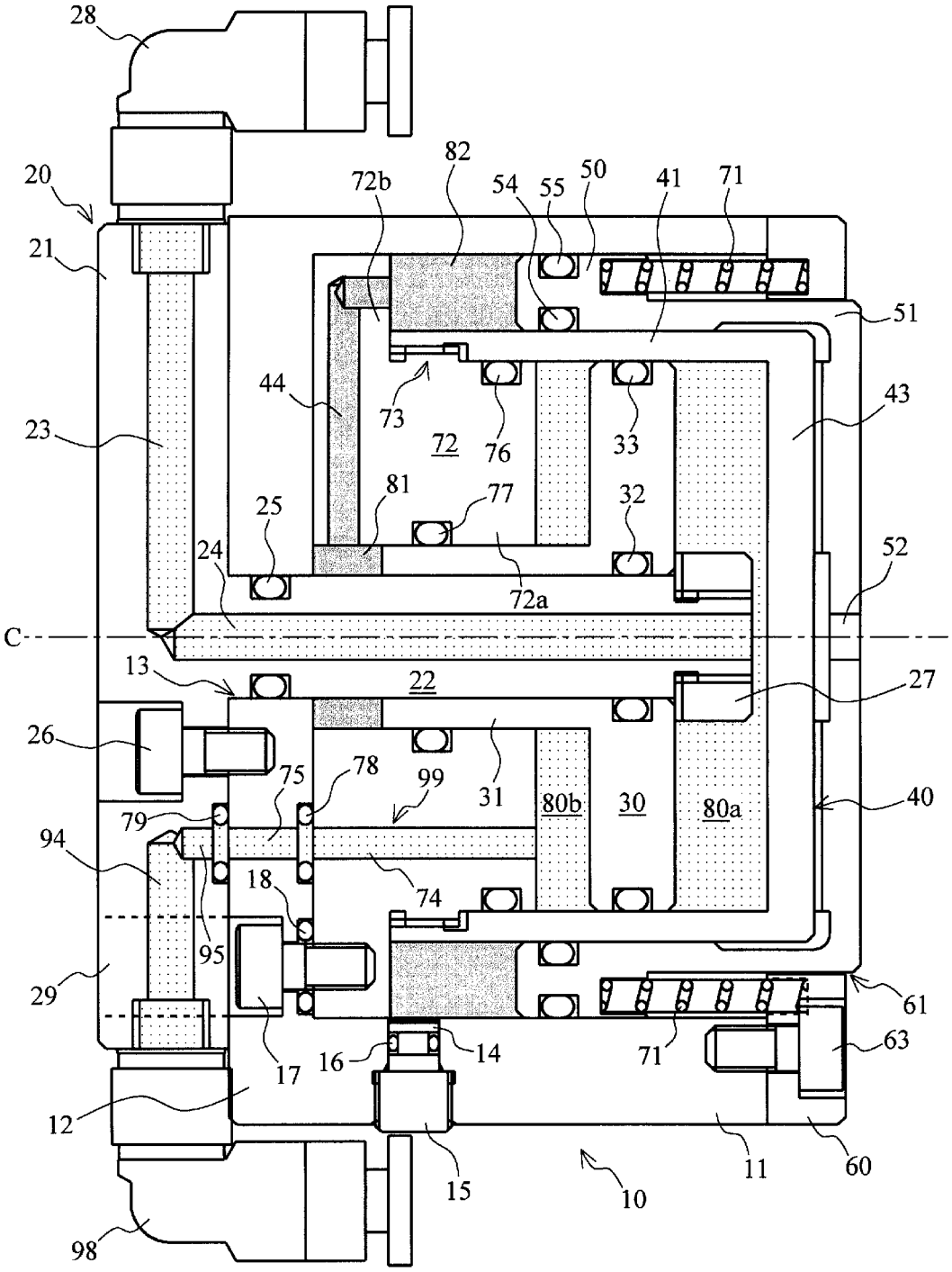
FIG. 10 illustrates a sectional view of an entire configuration of an air hydraulic cylinder according to a fourth embodiment.
Figure 11A:
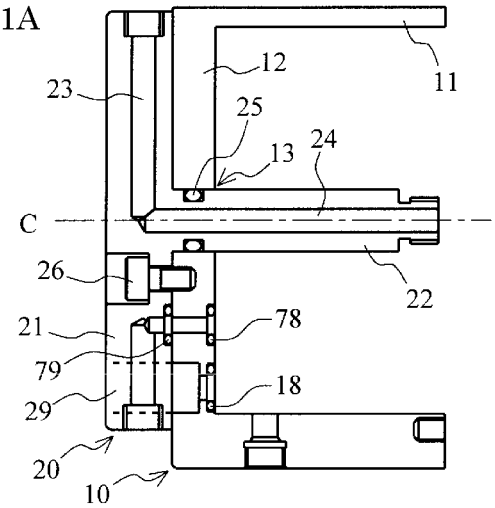
FIGS. 11A to 11C illustrate views of a part of an assembly procedure of the air hydraulic cylinder.
Figure 11B:
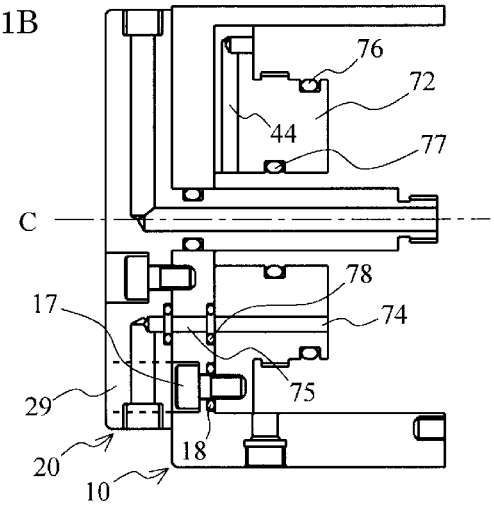
Figure 11C:
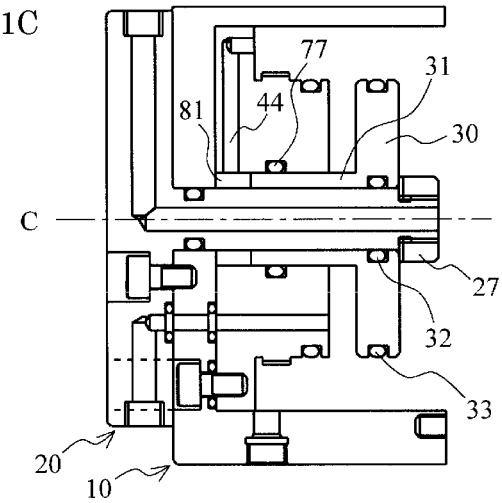
Figure 12D:
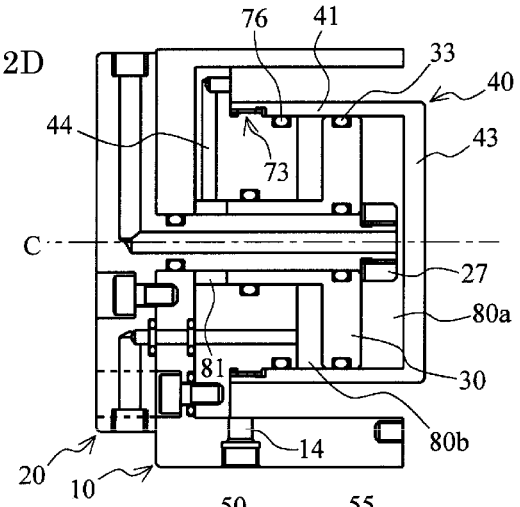
FIGS. 12D to 12F illustrate views of the rest of the assembly procedure of the air hydraulic cylinder.
Figure 12E:
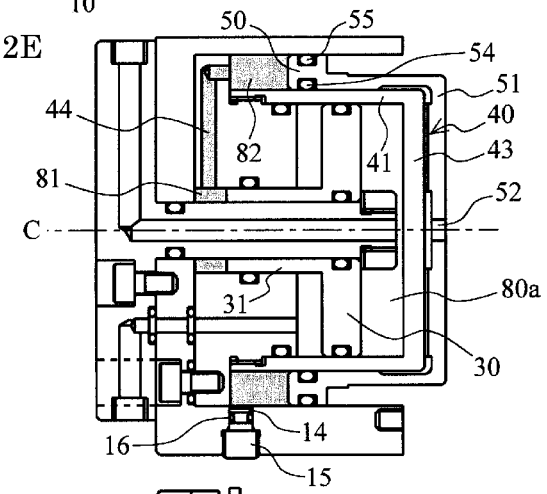
Figure 12F:
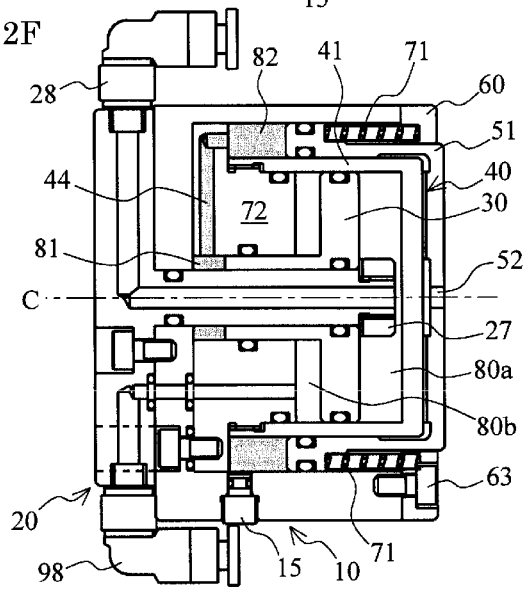

FIG. 10 illustrates a sectional view of an entire configuration of an air hydraulic cylinder 1 according to the fourth embodiment. In FIG. 10, the same reference signs are assigned to the same portions as those in the first to third embodiments, and thus the description thereof is appropriately omitted. Hereinafter, the description is provided by focusing on differences.

FIG. 10 illustrates section A-A' similar to FIG. 9B. Similar to the other embodiments, the pneumatic piping joint 28 and a pneumatic piping joint 98 are excluded from the targets of the cross section.

In the embodiment, a pneumatic chamber 80*b* for moving the first piston 30 in the output direction (right direction in the figure) is provided on a side opposite to the pneumatic chamber 80*a*, as well as the pneumatic chamber 80*a* for moving the first piston 30 in the retraction direction (left side on the figure).

The pneumatic chamber 80*a* functions as the pneumatic chamber for forward movement which causes the first piston 30 to move in the retraction direction and to cause the second piston 50 to move in the output direction in a reciprocal operation and the pneumatic chamber 80*b* functions as the pneumatic chamber for backward movement.

In the embodiment, since the systems of the supply air AR and the pneumatic chamber 80*b* for the backward movement are provided, the coil spring 70 is not disposed in the first embodiment.

In order to form the pneumatic chamber 80*b*, the first piston 30 of the embodiment is provided with through-holes through which the air pressure supply rod 22 penetrates, and the guide rod 31 having the same inner diameter as the diameter (inner diameter of the first piston 30) of the through-hole is formed from the first piston 30 in the retraction direction (left direction in the figure).

In this manner, the pneumatic chamber 80*b* is formed in a region between the guide rod 31 and the inner circular cylindrical portion 41.

The inner cylinder 40 of the embodiment is formed to include the lid portion 43 and the inner circular cylindrical portion 41 (the flange 42 is not present in the second embodiment), and a threaded portion 73 (female thread) is formed on an inner side of the inner circular cylindrical portion 41 on the side of the distal end.

Instead of the flange 42 in the second embodiment, an intermediate cylinder 72 is disposed in the outer cylinder 10 in a state in which the intermediate cylinder abuts on the outer cylinder lid 12.

The intermediate cylinder 72 has a body portion 72*a* and a flange portion 72*b* and is provided with a through-hole that is formed at the center of the intermediate cylinder and has the same diameter as the outer diameter of the guide rod 31, and the guide rod 31 is slidably disposed on the inner side of the through-hole in the direction of the central axis line C.

The body portion 72*a* is provided with the threaded portion 73 (male thread) on the side of the flange portion 72*b* and is screwed to the inner circular cylindrical portion 41. An end surface of the body portion 72*a* on a side opposite to the flange portion 72*b* in the direction of the central axis line C is opposite to the end surface of the first piston 30, thereby being in connect with the pneumatic chamber 80*b*.

The flange portion 72*b* of the intermediate cylinder 72 is formed to have an outer diameter equal to the inner diameter of the outer cylindrical unit 11.

The flange portion 72*b* is fixed in a state in which the entire end surface of the flange portion (surface on a side opposite to the body portion 72*a*) abuts on the surface on the inner side of the outer cylinder lid 12 of the outer cylinder 10, and the outer cylinder lid 12 is fixed to the lid 21.

In other words, as illustrated in FIG. 10, the outer cylinder lid 12 and the flange portion 72*b* are fixed with the plurality of bolts 17 from the side of the outer cylinder lid 12. In order to perform fixing with the bolts 17, the lid 21 of the air pressure supply unit 20 is provided with through-holes 29 at positions corresponding to the bolts 17.

The outer cylinder lid 12 is fixed to the lid 21 of the air pressure supply unit 20 with the bolts 26 from the side of the lid 21.

One of the bolts 17 and one of the bolts 26 fixing the lid 21 and the outer cylinder lid 12 according to the embodiment are illustrated in the section in FIG. 10; however, at least two bolts 17 and two bolts 26 are used and are disposed in a phase in which the holes are divided at substantially equal intervals on a circle with the central axis line C as the center. In addition, the positions of the bolts 17 and the bolts 26 in the radial direction may vary so as to have a distance from the central axis line C by which the bolts do not interfere with each other. In this case, the positions of the bolts are selected as positions at which the first air pressure supply path 23 and the second air pressure supply path 24 do not interfere with each other.

In the embodiment, since the fixing is performed with the bolts 17 through the outer cylinder lid 12 from the side of the lid 21, the sealing member 18 is disposed in the bolts 17 such that the oil OL in the first hydraulic chamber 81 and the second hydraulic chamber 82 does not flow out.

As described above, the intermediate cylinder 72 is provided with the through-hole having the same diameter as the outer diameter of the guide rod 31. The first hydraulic chamber 81 is formed in a region surrounded by the inner circumferential surface of the through-hole in the flange portion 72*b*, an annular distal end surface of the guide rod 31, an outer circumferential surface of the air pressure supply rod 22, and the outer cylinder lid 12.

On the other hand, the second hydraulic chamber 82 is formed in a region surrounded by an outer circumferential surface of the body portion 72*a*, a surface of the flange portion 72*b* on an outer side from the body portion 72*a*, an inner circumferential surface of the outer cylindrical unit 11, and the second piston 50.

In the second embodiment, the inner circular cylindrical portion 41 is provided with the communication holes 44 through which the first annular (donut shape) hydraulic chamber 81 and the second annular hydraulic chamber 82 communicate with each other in the radial direction (refer to FIG. 6).

In the embodiment, as illustrated in FIG. 10, the flange portion 72*b* is provided with a communication hole 44 through which the first hydraulic chamber 81 and the second hydraulic chamber 82 communicate with each other. The communication holes 44 causes a path continuous to the first hydraulic chamber 81 in the radial direction to communicate with a path continuous to the second hydraulic chamber 82 in the axial direction.

In the embodiment, two communication holes 44 are formed; however, in FIG. 10, one communicating hole 44 is illustrated in the relationship of the cut section. Here, the number of the communication holes 44 may be 1 or may be 3 or more.

The end surface (surface on the side opposite to the flange portion 72*b*) of the body portion 72*a* is in contact with the pneumatic chamber 80*b*. Therefore, a sealing member 77 is disposed on the side of the inner circumferential surface of the through-hole formed in the body portion 72*a* such that the oil OL in the first hydraulic chamber 81 does not flow out to the pneumatic chamber 80*b* through a space between the guide rod 31 and the body portion 72*a*.

In addition, the outer circumferential surface of the inner circular cylindrical portion 41 on the side of the distal end is in contact with the second hydraulic chamber 82, and the body portion 72*a* is disposed on the inner side of the inner circular cylindrical portion 41 on the side of the distal end. Therefore, a sealing member 76 is disposed on an outer circumferential surface of the body portion 72*a* such that the oil OL in the second hydraulic chamber 82 does not flow out to the pneumatic chamber 80*b*.

In the second embodiment, since the pneumatic chamber 80*b* is formed between the inner side of the guide rod 31 and the air pressure supply rod 22, the system for the backward path connected to the pneumatic chamber 80*b* is formed in the air pressure supply rod 22, similarly to the system for the forward path. Therefore, the second air pressure supply path 24 (for the forward path) and the fourth air pressure supply path 95 (for the backward path) are formed on the outer side from the central axis line C so as not to interfere with each other (refer to FIG. 6).

In the fourth embodiment, the inner circumferential surface of the guide rod 31 abuts on the air pressure supply rod 22, and thereby the pneumatic chamber 80*b* is formed between the outer side of the guide rod 31 and the inner circular cylindrical portion 41. In this manner, it is possible to secure a wide gap between the guide rod 31 and the inner circular cylindrical portion 41, that is, a wide width of the body portion 72*a* disposed between both of guide rod and the cylindrical portion (=(inner diameter of inner circular cylindrical portion 41−outer diameter of guide rod 31)/2).

In the embodiment, the system for the backward path that communicates with the pneumatic chamber 80*b* is formed so as to penetrate through not the air pressure supply rod 22 but the intermediate cylinder 72.

In other words, the through-hole 74 is formed in a direction parallel to the central axis line C of the intermediate cylinder 72, and the outer cylinder lid 12 is provided with a through-hole 75 through which the through-hole 74 communicates with the through-hole 29 of the lid 21. In this manner, a sixth air pressure supply path 99 is formed.

Since the sixth air pressure supply path 99 penetrates through the intermediate cylinder 72 that is positioned on the outer side from the air pressure supply rod 22, the fourth air pressure supply path 95 formed in the lid 21 is formed on the outer side from the air pressure supply rod 22 in the radial direction.

In addition, in the embodiment, since the sixth air pressure supply path 99 is formed on the outer side from the air pressure supply rod 22, the second air pressure supply path 24 for the forward path system is formed along the central axis line C of the air pressure supply rod 22.

As illustrated in FIG. 10, in order to prevent the supply air AR from leaking from the sixth air pressure supply path 99, a sealing member 79 is disposed at a connecting position between the fourth air pressure supply path 95 of the lid 21 and the through-hole 75 of the outer cylinder lid 12, and a sealing member 78 is disposed at a connecting position between the through-hole 75 of the outer cylinder lid 12 and the through-hole 74 of the intermediate cylinder 72.

Also in the embodiment, the coil spring 71 is disposed so as to apply a pressure in the retraction direction (left direction in the figure) to the second piston 50 having received the air pressure from the second hydraulic chamber 82 and to cause the second piston 50 to return in the retraction direction when the air pressure decreases.

However, in the first to third embodiments, the coil spring 71 having a large diameter is disposed to have the inner diameter which is the same as the outer diameter of the circular cylindrical output portion 51. In the present embodiment, the width and the outer diameter of the outer cylindrical unit 11 and the circular cylindrical output portion 51 are substantially equal to each other, and three or more coil springs 71 having a small diameter are disposed at equal intervals.

Recessed portions for fixing the coil springs 71 having the small diameter are formed at positions which are opposite to the second piston 50 and the lid 60, respectively.

Instead of the plurality of coil springs 71 disposed to have the small diameters, one coil spring 71 having the large diameter may be disposed, similarly to the first embodiment.

Next, a method of manufacturing the air hydraulic cylinder 1 according to the fourth embodiment will be described.

FIGS. 11A to 12F illustrate an assembly procedure of the air hydraulic cylinder 1 according to the fourth embodiment.

The following assembly procedure (a) to (f) corresponds to FIGS. 11A to 11C and FIGS. 12D to 12F.

(a) First, the sealing member 25 is set in the air pressure supply rod 22 of the air pressure supply unit 20, and the sealing member 79 is set in the lid 21. In addition, the sealing member 78 and the sealing member 18 are set in the outer cylinder lid 12 of the outer cylinder 10.

The air pressure supply rod 22 is inserted into the through-hole 13 of the outer cylinder 10, and the outer cylinder lid 12 and the lid 21 abut on each other. The lid 21 and the outer cylinder lid 12 are fixed with the plurality of bolts 26 from the side of the lid 21. In this manner, the outer cylinder 10 and the air pressure supply unit 20 are fixed to each other.

(b) The sealing member 77 is set on the inner circumferential surface of the body portion 72*a*, and the sealing member 76 is set on the outer circumferential surface thereof.

The intermediate cylinder 72 is inserted into the outer cylinder 10 while sliding on the outer circumferential surface of the flange portion 72*b* on the inner circumferential surface of the outer cylindrical unit 11. At the same time, the air pressure supply rod 22 inserted into the outer cylinder 10 is inserted into the through-hole of the intermediate cylinder 72.

(c) Next, the inner circumference sealing member 32 is set on the inner circumferential surface of the first piston 30, and the sealing member 33 is set on the outer circumferential surface thereof.

The air pressure supply rod 22 is inserted into the through-holes in the first piston 30 and the guide rod 31. In this case, the distal end of the guide rod 31 is disposed between the air pressure supply rod 22 and the intermediate cylinder 72 so as to be positioned on the side of the lid 21 from the sealing member 77.

The sealing nut 27 for sealing the inserted first piston 30 is screwed to the distal end of the air pressure supply rod 22.

(d) Next, the first piston 30 and the body portion 72*a* are inserted into the inner circular cylindrical portion 41 of the inner cylinder 40, and the inner circular cylindrical portion 41 and the intermediate cylinder 72 are screwed at the threaded portion 73 and are fixed to each other.

(e) Next, the inner circumference sealing member 54 and the outer circumference sealing member 55 are set in the second piston 50, and the inner circular cylindrical portion 41 of the inner cylinder 40 and the lid portion 43 are inserted into the circular cylindrical output portion 51 and the second piston 50.

The oil OL is injected into the second hydraulic chamber 82, the communication holes 44, and the first hydraulic chamber 81 from the oil supply hole 14 and the chambers and hole are sealed with the sealing screw 15.

(f) Next, one side of ends of the coil springs 71 having the small diameter enter a plurality of recessed portions formed in the second piston 50, and thereby the coil springs 71 are set.

The circular cylindrical output portion 51 passes through the hole 61 of the lid 60, and the lid 60 is fixed to the outer cylinder 10 with four bolts 63 such that the other side of ends of the coil springs 71 enter the recessed portions formed in the lid 60.

The pneumatic piping joint 28 may be attached in any stages of (a) to (f).

In addition, in the embodiment, a case where one oil supply hole 14 is formed is described; however, a plurality of oil supply holes 14 may be provided. In this case, when the oil is injected from one oil supply hole 14, internal air is likely to be exhausted and thus oil injecting work is easily performed when the other oil supply hole 14 is open by releasing the sealing screw 15.

Next, operations of the air hydraulic cylinder 1 of the fourth embodiment will be described.

Figure 13A:
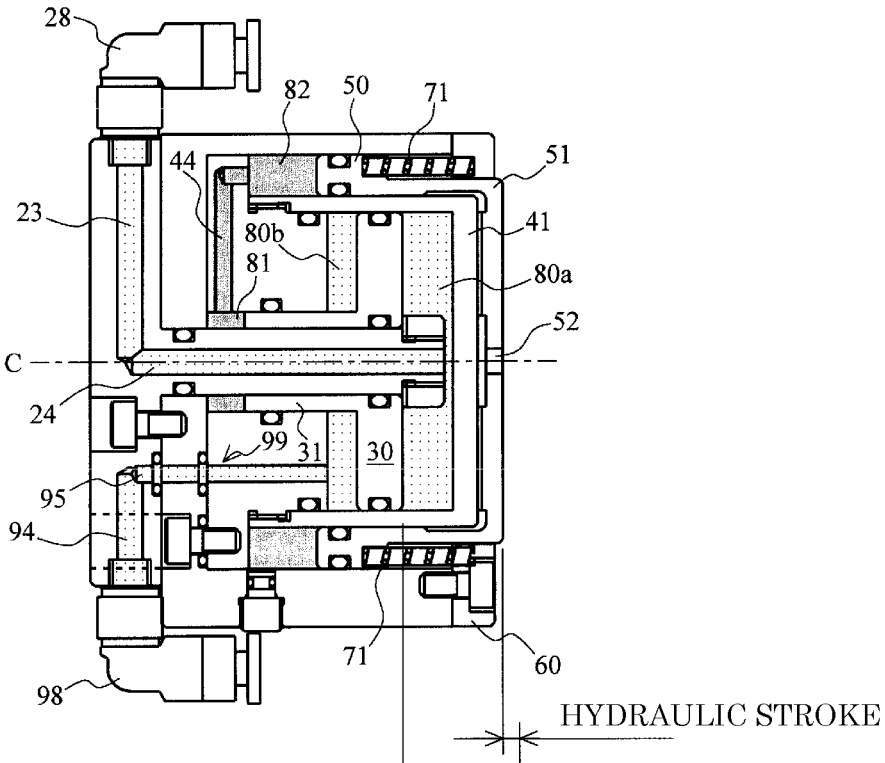
FIGS. 13A and 13B illustrate views of movement states of portions along with movement of a pneumatic piston in the air hydraulic cylinder.
Figure 13B:
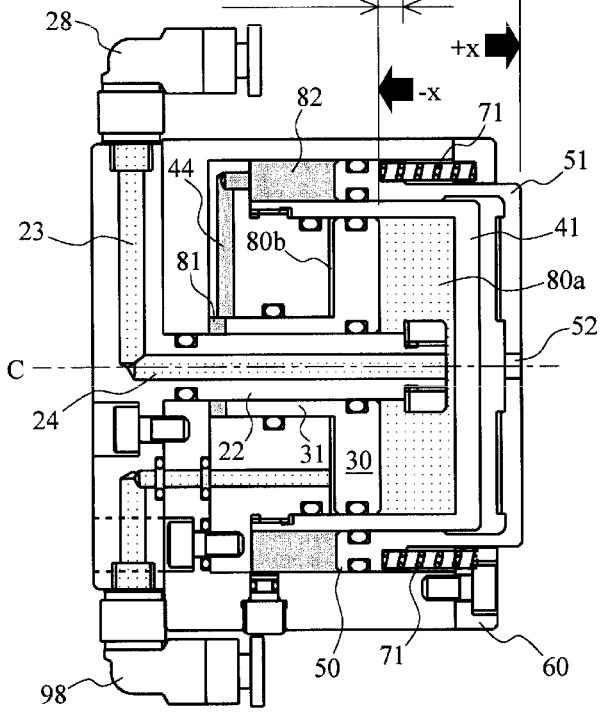

FIGS. 13A and 13B illustrate views of sections showing movement states of portions along with the movement of the pneumatic piston in the air hydraulic cylinder 1 of the fourth embodiment.

In the following description of operations, similar to the description of the other embodiments, from the viewpoint of an operation direction of the circular cylindrical output portion 51, the left direction toward FIGS. 13A and 13B is referred to as the retraction direction, and the right direction thereof is referred to as the output direction.

In a case where the first piston 30 moves onward in the retraction direction, in order for the supply air AR in the pneumatic chamber 80*b* to flow out to the outside through the third air pressure supply path 94, the fourth air pressure supply path 95, and the sixth air pressure supply path 99 in a start state in FIG. 13A, an end of a flow path of a hose (not illustrated) connected to the pneumatic piping joint 98 is open to the atmosphere.

In this state, the supply air AR is supplied from the pneumatic piping joint 28. The supply air AR is supplied to the pneumatic chamber 80*a* through the first air pressure supply path 23 and the second air pressure supply path 24.

As described above, when the supply air AR is supplied to the pneumatic chamber 80*a*, the first piston 30 is pushed by the supply air AR of the pneumatic chamber 80*a* and moves in the retraction direction because the side of the pneumatic chamber 80*b* is open.

In the embodiment, compared to the second embodiment, since the area of the distal end of the guide rod 31 (the projected area S1 of the guide rod 31 in the first hydraulic chamber 81) is set to be smaller than the projected area Sa of the first piston 30 in the pneumatic chamber 80*a*, it is possible to apply, to the first hydraulic chamber 81, an input pressure that is more significantly amplified.

Therefore, the guide rod 31 also moves in the retraction direction along with the movement of the first piston 30, and thereby a significant input pressure is applied to the first hydraulic chamber 81 such that the first hydraulic chamber 81 decreases in volume.

The first hydraulic chamber 81 decreases in volume. In this manner, similar to the description in the second embodiment, the hydraulic pressure of the second hydraulic chamber 82 is amplified such that the second piston 50 and the circular cylindrical output portion 51 move in the output direction, and the state in FIG. 13B is obtained.

In the embodiment, since the projected area S1 of the guide rod 31 in the first hydraulic chamber 81 is set to be small, a ratio of the projected area S2 to the projected area S1 (projected area S2 of the second piston 50 in the second hydraulic chamber 82) increases, and thereby it is possible to output the thrust larger than that in the second embodiment from the circular cylindrical output portion 51.

Next, a case where the second piston 50 and the circular cylindrical output portion 51 are retracted from the state illustrated in FIG. 13B is described.

In this case, in order for the supply air AR in the pneumatic chamber 80*a* to flow out to the outside through the first air pressure supply path 23 and the second air pressure supply path 24, an end of a flow path of a hose (not illustrated) connected to the pneumatic piping joint 28 is open to the atmosphere.

The supply air AR is supplied to the pneumatic chamber 80*b* from the pneumatic piping joint 98 via the third air pressure supply path 94, the fourth air pressure supply path 95, and the sixth air pressure supply path 99.

When the supply air AR is supplied to the pneumatic chamber 80*b*, the pressure on the side of the pneumatic chamber 80*b* becomes higher than the side of the pneumatic chamber 80*a* due to the supply pressure, the first piston 30 moves in the output direction (right side on the figure), and the volume of the second hydraulic chamber 82 returns to the original size. In this manner, the hydraulic pressure of both of the second piston 50 and the circular cylindrical output portion 51 decreases, and thereby the portions return to the start position.

According to the fourth embodiment described above, it is possible to achieve the following effects according to the double-acting type air hydraulic cylinder 1.

(1) It is possible to increase an area ratio of the projected area Sa of the surface on which the end surface of the first piston 30 is in contact with the pneumatic chamber 80*a* on the perpendicular plane to the central axis line C and the projected area S1 of the surface on which the distal end surface of the guide rod 31 is in contact with the oil OL in the first hydraulic chamber 81 on the perpendicular plane to the central axis line C, and thereby it is possible to further increase the input pressure to the hydraulic chamber.

(2) In addition, it is possible to further increase an area ratio of the projected area S1 of the distal end surface of the guide rod 31 which is in contact with the oil OL in the first hydraulic chamber 81 on the perpendicular plane and the projected area S2 of the second piston 50 which is in contact with the second hydraulic chamber 82, and thereby it is possible to further increase the hydraulic output.

In other words, compared to the second embodiment, even if a width of the first hydraulic chamber 81 (=(outer diameter−inner diameter)/2) in the radial direction is equal, the inner diameter (outer diameter) is smaller in the fourth embodiment. Therefore, it is possible to reduce the projected area S1 with respect to the first hydraulic chamber 81.

Hence, compared to the second embodiment, the area ratio of projected area Sa/projected area S1 is increased in such a configuration, and thus it is possible to increase a ratio of amplifying a force that presses the hydraulic chamber (the first hydraulic chamber 81, the second hydraulic chamber 82, and the communication holes 44) with the air pressure.

(3) In addition, since projected area S2/projected area S1 is also increased in this configuration, it is possible to increase a ratio of thrust amplification in the hydraulic chamber.

(4) Further, it is possible to further increase a projected area Sb of a surface of the first piston 30 which is in contact with the pneumatic chamber 80 on the perpendicular plane to the central axis line C than that in the second embodiment. In this manner, the first piston 30 can smoothly return to a position of an initial state.

What is claimed is:

1. A fluid pressure cylinder comprising:

a housing;

a first fluid chamber that is formed in the housing and is filled with a first fluid;

a second fluid chamber that is formed in the housing and is filled with a second fluid;

a first piston that functions as a partition between the first fluid chamber and the second fluid chamber, receives a pressure of the first fluid so as to move in an axial direction of the housing, and pressurizes the second fluid, the first piston having a first side surface in contact with the first fluid and a second side surface in contact with the second fluid; and a second piston having an annular shape, which is disposed on an outer side from the first piston in a radial direction thereof and receives a pressure of the second fluid pressurized by the first piston so as to move in the axial direction of the housing, the second piston having a first side surface in contact with the second fluid, wherein the second fluid chamber is formed such that the second side surface of the first piston which pressurizes the second fluid is disposed in the same direction as the first side surface of the second piston which receives the pressure of the second fluid.

2. The fluid pressure cylinder according to claim 1, wherein the second fluid chamber includes a first chamber in which the second fluid inside is in contact with the second side surface of the first piston, a second chamber which is formed on an outer side from the first chamber in the radial direction and in which the second fluid inside is in contact with the first side surface of the second piston, and a communication path through which the first chamber and the second chamber communicate with each other.

3. The fluid pressure cylinder according to claim 1, further comprising:

a first fluid supply path that communicates with the first fluid chamber through an inner side from the first piston in the radial direction and supplies the first fluid into the first fluid chamber.

4. The fluid pressure cylinder according to claim 3, further comprising:

an inner cylindrical portion disposed on the inner side from the housing in the radial direction; and a central rod disposed on the inner side from the inner cylindrical portion in the radial direction, wherein the first fluid supply path is formed in the central rod, wherein the first piston is disposed between the central rod and the inner cylindrical portion, and wherein the second piston is disposed between the inner cylindrical portion and the housing.

5. The fluid pressure cylinder according to claim 1, wherein the first fluid is a compressible fluid or an incompressible fluid, and wherein the second fluid is a compressible fluid or an incompressible fluid.

6. The fluid pressure cylinder according to claim 1, further comprising:

a third fluid chamber that is formed on a side of the first piston which is opposite to the first fluid chamber in the axial direction and is filled with the first fluid;

a first fluid supply path that supplies the first fluid into the first fluid chamber through an inner side from the first piston in the radial direction; and a second fluid supply path that supplies the first fluid into the third fluid chamber, wherein the first piston moves in the axial direction due to a pressure difference in the first fluid between the first fluid chamber and the third fluid chamber.

7. The fluid pressure cylinder according to claim 6, further comprising:

an inner cylindrical portion disposed on an inner side from the housing in the radial direction; and a central rod disposed on an inner side from the inner cylindrical portion in the radial direction, wherein the first fluid supply path is formed in the central rod, wherein the first piston has a circular cylinder-shaped guide rod, which extends to a side of the second fluid chamber and pressurizes the second fluid, and is disposed between the central rod and the inner cylindrical portion, and wherein the second piston is disposed between the inner cylindrical portion and the housing.

8. The fluid pressure cylinder according to claim 7, wherein the third fluid chamber is disposed on an inner side from the guide rod and between the central rod and the guide rod.

9. The fluid pressure cylinder according to claim 7, wherein the third fluid chamber is disposed on an outer side from the guide rod and between the inner cylindrical portion and the guide rod.

10. A fluid pressure cylinder comprising:

a housing;

a first fluid chamber that is formed in the housing and is filled with a first fluid;

a second fluid chamber that is formed in the housing and is filled with a second fluid;

a first piston that functions as a partition between the first fluid chamber and the second fluid chamber, receives a pressure of the first fluid so as to move in an axial direction of the housing, and pressurizes the second fluid; and a second piston having an annular shape, which is disposed on an outer side from the first piston in a radial direction thereof and receives a pressure of the second fluid pressurized by the first piston so as to move in the axial direction of the housing, wherein the second fluid chamber is formed such that a surface of the first piston which pressurizes the second fluid is disposed in the same direction as a surface of the second piston which receives the pressure of the second fluid, wherein the second fluid chamber includes:

a first chamber in which the second fluid inside is in contact with the first piston, a second chamber which is formed on an outer side from the first chamber in the radial direction and in which the second fluid inside is in contact with the second piston, and a communication path through which the first chamber and the second chamber communicate with each other.

11. The fluid pressure cylinder according to claim 10, further comprising:

a first fluid supply path that communicates with the first fluid chamber through an inner side from the first piston in the radial direction and supplies the first fluid into the first fluid chamber.

12. The fluid pressure cylinder according to claim 11, further comprising:

an inner cylindrical portion disposed on the inner side from the housing in the radial direction; and a central rod disposed on the inner side from the inner cylindrical portion in the radial direction, wherein the first fluid supply path is formed in the central rod, wherein the first piston is disposed between the central rod and the inner cylindrical portion, and wherein the second piston is disposed between the inner cylindrical portion and the housing.

13. The fluid pressure cylinder according to claim 10, wherein the first fluid is a compressible fluid or an incompressible fluid, and wherein the second fluid is a compressible fluid or an incompressible fluid.

14. The fluid pressure cylinder according to claim 10, further comprising:

a third fluid chamber that is formed on a side of the first piston which is opposite to the first fluid chamber in the axial direction and is filled with the first fluid;

a first fluid supply path that supplies the first fluid into the first fluid chamber through an inner side from the first piston in the radial direction; and a second fluid supply path that supplies the first fluid into the third fluid chamber, wherein the first piston moves in the axial direction due to a pressure difference in the first fluid between the first fluid chamber and the third fluid chamber.

15. The fluid pressure cylinder according to claim 14, further comprising:

an inner cylindrical portion disposed on an inner side from the housing in the radial direction; and a central rod disposed on an inner side from the inner cylindrical portion in the radial direction, wherein the first fluid supply path is formed in the central rod, wherein the first piston has a circular cylinder-shaped guide rod, which extends to a side of the second fluid chamber and pressurizes the second fluid, and is disposed between the central rod and the inner cylindrical portion, and wherein the second piston is disposed between the inner cylindrical portion and the housing.

16. The fluid pressure cylinder according to claim 15, wherein the third fluid chamber is disposed on an inner side from the guide rod and between the central rod and the guide rod.

17. The fluid pressure cylinder according to claim 15, wherein the third fluid chamber is disposed on an outer side from the guide rod and between the inner cylindrical portion and the guide rod.

18. A fluid pressure cylinder comprising:

a housing;

a first fluid chamber that is formed in the housing and is filled with a first fluid;

a second fluid chamber that is formed in the housing and is filled with a second fluid;

a first piston that functions as a partition between the first fluid chamber and the second fluid chamber, receives a pressure of the first fluid so as to move in an axial direction of the housing, and pressurizes the second fluid; and a second piston having an annular shape, which is disposed on an outer side from the first piston in a radial direction thereof and receives a pressure of the second fluid pressurized by the first piston so as to move in the axial direction of the housing, wherein the second fluid chamber is formed such that a surface of the first piston which pressurizes the second fluid is disposed in the same direction as a surface of the second piston which receives the pressure of the second fluid, the fluid pressure cylinder further comprising:

a third fluid chamber that is formed on a side of the first piston which is opposite to the first fluid chamber in the axial direction and is filled with the first fluid;

a first fluid supply path that supplies the first fluid into the first fluid chamber through an inner side from the first piston in the radial direction;

a second fluid supply path that supplies the first fluid into the third fluid chamber, an inner cylindrical portion disposed on an inner side from the housing in the radial direction; and a central rod disposed on an inner side from the inner cylindrical portion in the radial direction, wherein the first piston moves in the axial direction due to a pressure difference in the first fluid between the first fluid chamber and the third fluid chamber, wherein the first fluid supply path is formed in the central rod, wherein the first piston has a circular cylinder-shaped guide rod, which extends to a side of the second fluid chamber and pressurizes the second fluid, and is disposed between the central rod and the inner cylindrical portion, and wherein the second piston is disposed between the inner cylindrical portion and the housing.

19. The fluid pressure cylinder according to claim 18, wherein the third fluid chamber is disposed on an inner side from the guide rod and between the central rod and the guide rod.

20. The fluid pressure cylinder according to claim 18, wherein the third fluid chamber is disposed on an outer side from the guide rod and between the inner cylindrical portion and the guide rod.

* * * * *